US007648227B2

(12) United States Patent
Benjamin et al.

(10) Patent No.: US 7,648,227 B2
(45) Date of Patent: Jan. 19, 2010

(54) FLUID EJECTION DEVICE WITH DATA SIGNAL LATCH CIRCUITRY

(75) Inventors: Trudy Benjamin, Portland, OR (US); James P. Axtell, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 414 days.

(21) Appl. No.: 11/263,733

(22) Filed: Oct. 31, 2005

(65) Prior Publication Data

US 2007/0097178 A1 May 3, 2007

(51) Int. Cl.
*B41J 2/05* (2006.01)

(52) U.S. Cl. ..... 347/58; 347/57; 347/9; 347/12; 347/40

(58) Field of Classification Search ..... 347/10–12, 347/15, 40, 57–59
See application file for complete search history.

(56) References Cited

U.S. PATENT DOCUMENTS

| | | | | |
|---|---|---|---|---|
| 5,635,968 | A * | 6/1997 | Bhaskar et al. | 347/59 |
| 6,027,198 | A * | 2/2000 | Tanaka et al. | 347/12 |
| 6,312,079 | B1 | 11/2001 | Anderson et al. | |
| 6,409,300 | B2 | 6/2002 | Imanaka et al. | |
| 6,428,138 | B1 | 8/2002 | Asauchi et al. | |
| 6,439,697 | B1 * | 8/2002 | Axtell et al. | 347/57 |
| 6,532,032 | B2 | 3/2003 | Dunham et al. | |
| 6,540,333 | B2 * | 4/2003 | Axtell et al. | 347/57 |
| 6,547,356 | B2 | 4/2003 | Edelen et al. | |
| 6,607,257 | B2 | 8/2003 | Szumla et al. | |
| 6,619,775 | B2 | 9/2003 | Tsuruoka | |
| 6,908,169 | B2 | 6/2005 | Kanematsu et al. | |
| 2002/0018086 | A1 * | 2/2002 | Kao et al. | 347/12 |
| 2003/0142163 | A1 | 7/2003 | Nakayama et al. | |
| 2004/0004643 | A1 | 1/2004 | Satomura | |
| 2004/0201636 | A1 | 10/2004 | Sato et al. | |
| 2005/0116975 | A1 | 6/2005 | Kasai | |
| 2005/0140703 | A1 | 6/2005 | Ou et al. | |
| 2005/0230493 | A1 | 10/2005 | Benjamin et al. | |

FOREIGN PATENT DOCUMENTS

| | | |
|---|---|---|
| EP | 0816082 | 1/1998 |
| JP | 04329158 | 11/1992 |
| JP | 05024239 | 2/1993 |

OTHER PUBLICATIONS

International Search Report for Application No. PCT/US2006/061400. Report issued Aug. 18, 2008.

* cited by examiner

*Primary Examiner*—Matthew Luu
*Assistant Examiner*—Henok Legesse

(57) ABSTRACT

A fluid ejection device includes a first fire line, a second fire line, data lines, latch circuitry, first drop generators, and second drop generators. The first fire line is adapted to conduct a first energy signal including first energy pulses and the second fire line is adapted to conduct a second energy signal including second energy pulses. The data lines are adapted to conduct data signals that represent an image and the latch circuitry is configured to latch the data signals to provide latched data signals based on at least one clock signal. The first drop generators are configured to respond to the first energy signal to eject fluid based on the latched data signals and the second drop generators are configured to respond to the second energy signal to eject fluid based on the latched data signals.

16 Claims, 14 Drawing Sheets

FLUID EJECTION DEVICE WITH DATA SIGNAL LATCH CIRCUITRY

BACKGROUND

An inkjet printing system, as one embodiment of a fluid ejection system, may include a printhead, an ink supply that provides liquid ink to the printhead, and an electronic controller that controls the printhead. The printhead, as one embodiment of a fluid ejection device, ejects ink drops through a plurality of orifices or nozzles. The ink is projected toward a print medium, such as a sheet of paper, to print an image onto the print medium. The nozzles are typically arranged in one or more arrays, such that properly sequenced ejection of ink from the nozzles causes characters or other images to be printed on the print medium as the printhead and the print medium are moved relative to each other.

In a typical thermal inkjet printing system, the printhead ejects ink drops through nozzles by rapidly heating small volumes of ink located in vaporization chambers. The ink is heated with small electric heaters, such as thin film resistors referred to herein as firing resistors. Heating the ink causes the ink to vaporize and be ejected through the nozzles.

To eject one drop of ink, the electronic controller that controls the printhead activates an electrical current from a power supply external to the printhead. The electrical current is passed through a selected firing resistor to heat the ink in a corresponding selected vaporization chamber and eject the ink through a corresponding nozzle. Known drop generators include a firing resistor, a corresponding vaporization chamber, and a corresponding nozzle.

As inkjet printheads have evolved, the number of drop generators in a printhead has increased to improve printing speed and/or quality. The increase in the number of drop generators per printhead has resulted in a corresponding increase in the number of input pads required on a printhead die to energize the increased number of firing resistors. In one type of printhead, each firing resistor is coupled to a corresponding input pad to provide power to energize the firing resistor. One input pad per firing resistor becomes impractical as the number of firing resistors increases.

The number of drop generators per input pad is significantly increased in another type of printhead having primitives. A single power lead provides power to all firing resistors in one primitive. Each firing resistor is coupled in series with the power lead and the drain-source path of a corresponding field effect transistor (FET). The gate of each FET in a primitive is coupled to a separately energizable address lead that is shared by multiple primitives.

Manufacturers continue increasing the number of drop generators per input pad via reducing the number of input pads and/or increasing the number of drop generators on a printhead die. A printhead with fewer input pads typically costs less than a printhead with more input pads. Also, a printhead with more drop generators typically prints with higher quality and/or printing speed.

For these and other reasons, there is a need for the present invention.

SUMMARY

One aspect of the present invention provides a fluid ejection device including a first fire line, a second fire line, data lines, latch circuitry, first drop generators, and second drop generators. The first fire line is adapted to conduct a first energy signal including first energy pulses and the second fire line is adapted to conduct a second energy signal including second energy pulses. The data lines are adapted to conduct data signals that represent an image and the latch circuitry is configured to latch the data signals to provide latched data signals based on at least one clock signal. The first drop generators are configured to respond to the first energy signal to eject fluid based on the latched data signals and the second drop generators are configured to respond to the second energy signal to eject fluid based on the latched data signals.

BRIEF DESCRIPTION OF THE DRAWINGS

Embodiments of the invention are better understood with reference to the following drawings. The elements of the drawings are not necessarily to scale relative to each other. Like reference numerals designate corresponding similar parts.

DETAILED DESCRIPTION

In the following detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
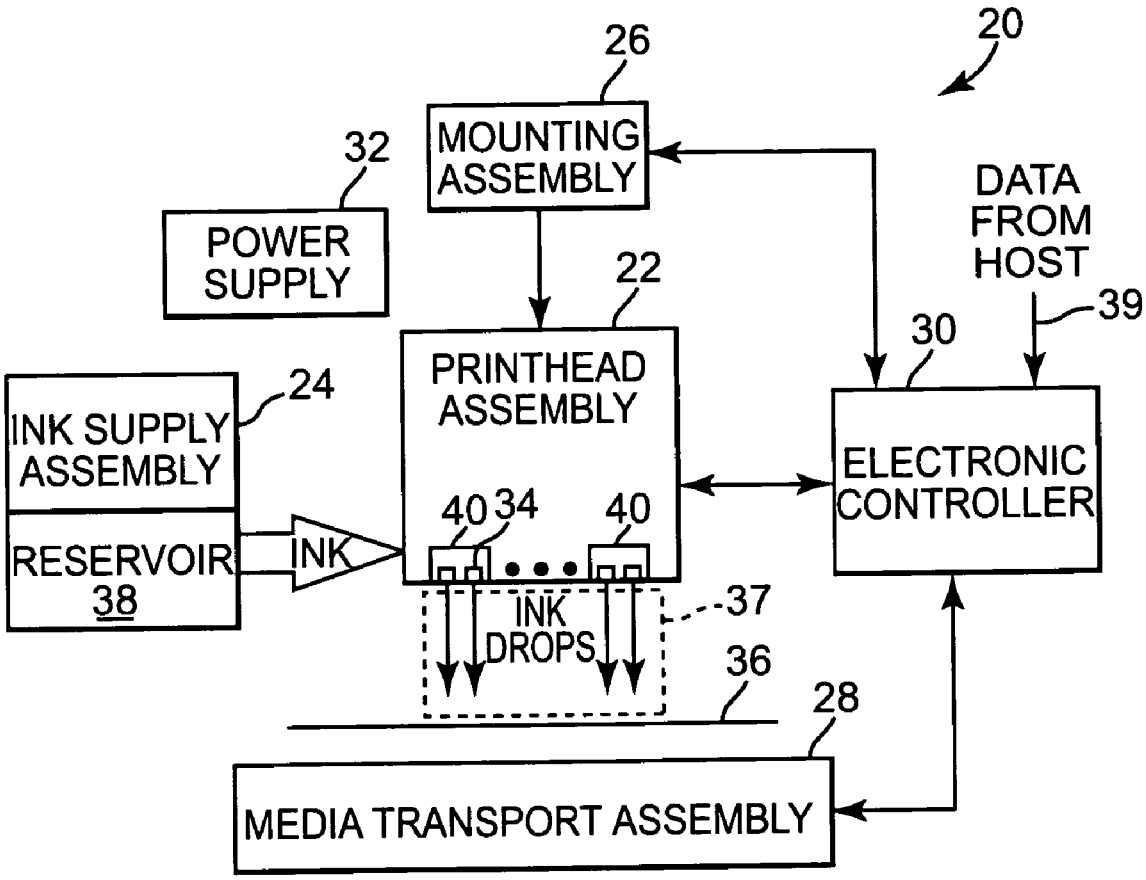
FIG. 1 illustrates one embodiment of an inkjet printing system.

FIG. 1 illustrates one embodiment of an inkjet printing system 20. Inkjet printing system 20 constitutes one embodiment of a fluid ejection system that includes a fluid ejection device, such as inkjet printhead assembly 22, and a fluid supply assembly, such as ink supply assembly 24. The inkjet printing system 20 also includes a mounting assembly 26, a media transport assembly 28, and an electronic controller 30. At least one power supply 32 provides power to the various electrical components of inkjet printing system 20.

In one embodiment, inkjet printhead assembly 22 includes at least one printhead or printhead die 40 that ejects drops of ink through a plurality of orifices or nozzles 34 toward a print medium 36 so as to print onto print medium 36. Printhead 40 is one embodiment of a fluid ejection device. Print medium 36 may be any type of suitable sheet material, such as paper, card stock, transparencies, Mylar, fabric, and the like. Typically, nozzles 34 are arranged in one or more columns or arrays such that properly sequenced ejection of ink from nozzles 34 causes characters, symbols, and/or other graphics or images to be printed upon print medium 36 as inkjet printhead assembly 22 and print medium 36 are moved relative to each other. While the following description refers to the ejection of ink from printhead assembly 22, it is understood that other liquids, fluids or flowable materials, including clear fluid, may be ejected from printhead assembly 22.

Ink supply assembly 24 as one embodiment of a fluid supply assembly provides ink to printhead assembly 22 and includes a reservoir 38 for storing ink. As such, ink flows from reservoir 38 to inkjet printhead assembly 22. Ink supply assembly 24 and inkjet printhead assembly 22 can form either a one-way ink delivery system or a recirculating ink delivery system. In a one-way ink delivery system, substantially all of the ink provided to inkjet printhead assembly 22 is consumed during printing. In a recirculating ink delivery system, only a portion of the ink provided to printhead assembly 22 is consumed during printing. As such, ink not consumed during printing is returned to ink supply assembly 24.

In one embodiment, inkjet printhead assembly 22 and ink supply assembly 24 are housed together in an inkjet cartridge or pen. The inkjet cartridge or pen is one embodiment of a fluid ejection device. In another embodiment, ink supply assembly 24 is separate from inkjet printhead assembly 22 and provides ink to inkjet printhead assembly 22 through an interface connection, such as a supply tube (not shown). In either embodiment, reservoir 38 of ink supply assembly 24 may be removed, replaced, and/or refilled. In one embodiment, where inkjet printhead assembly 22 and ink supply assembly 24 are housed together in an inkjet cartridge, reservoir 38 includes a local reservoir located within the cartridge and may also include a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 26 positions inkjet printhead assembly 22 relative to media transport assembly 28 and media transport assembly 28 positions print medium 36 relative to inkjet printhead assembly 22. Thus, a print zone 37 is defined adjacent to nozzles 34 in an area between inkjet printhead assembly 22 and print medium 36. In one embodiment, inkjet printhead assembly 22 is a scanning type printhead assembly. As such, mounting assembly 26 includes a carriage (not shown) for moving inkjet printhead assembly 22 relative to media transport assembly 28 to scan print medium 36. In another embodiment, inkjet printhead assembly 22 is a non-scanning type printhead assembly. As such, mounting assembly 26 fixes inkjet printhead assembly 22 at a prescribed position relative to media transport assembly 28. Thus, media transport assembly 28 positions print medium 36 relative to inkjet printhead assembly 22.

Electronic controller or printer controller 30 typically includes a processor, firmware, and other electronics, or any combination thereof, for communicating with and controlling inkjet printhead assembly 22, mounting assembly 26, and media transport assembly 28. Electronic controller 30 receives data 39 from a host system, such as a computer, and usually includes memory for temporarily storing data 39. Typically, data 39 is sent to inkjet printing system 20 along an electronic, infrared, optical, or other information transfer path. Data 39 represents, for example, a document and/or file to be printed. As such, data 39 forms a print job for inkjet printing system 20 and includes one or more print job commands and/or command parameters.

In one embodiment, electronic controller 30 controls inkjet printhead assembly 22 for ejection of ink drops from nozzles 34. As such, electronic controller 30 defines a pattern of ejected ink drops that form characters, symbols, and/or other graphics or images on print medium 36. The pattern of ejected ink drops is determined by the print job commands and/or command parameters.

In one embodiment, inkjet printhead assembly 22 includes one printhead 40. In another embodiment, inkjet printhead assembly 22 is a wide-array or multi-head printhead assembly. In one wide-array embodiment, inkjet printhead assembly 22 includes a carrier, which carries printhead dies 40, provides electrical communication between printhead dies 40 and electronic controller 30, and provides fluidic communication between printhead dies 40 and ink supply assembly 24.

Figure 2:
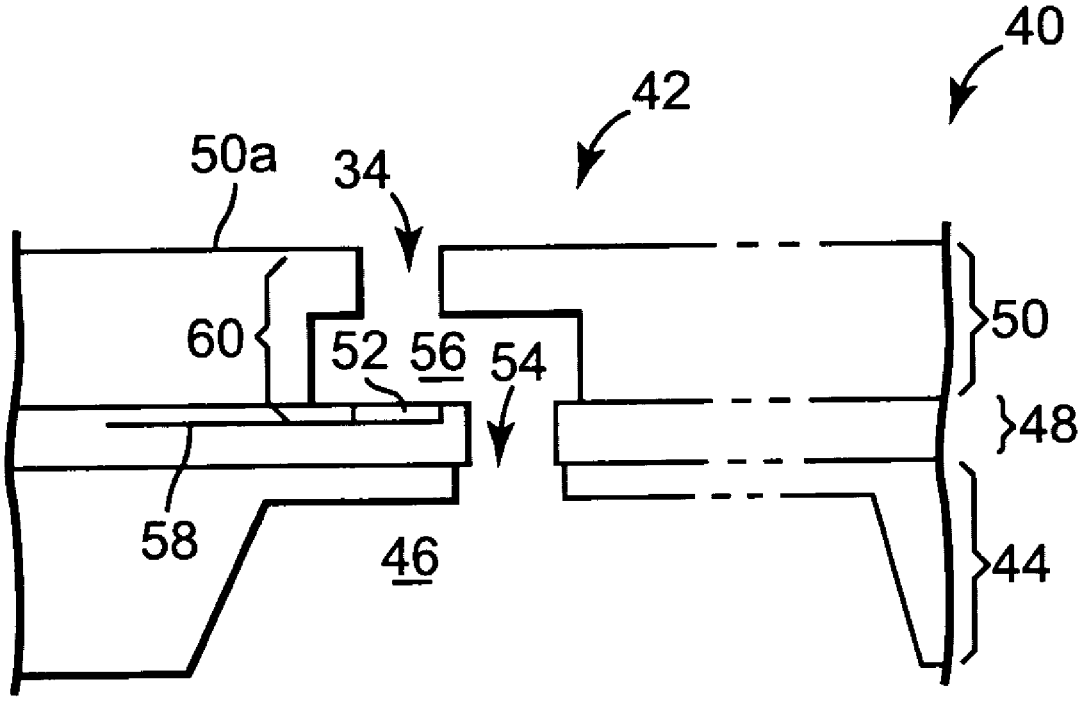
FIG. 2 is a diagram illustrating a portion of one embodiment of a printhead die.

FIG. 2 is a diagram illustrating a portion of one embodiment of a printhead die 40. The printhead die 40 includes an array of printing or fluid ejecting elements 42. Printing elements 42 are formed on a substrate 44, which has an ink feed slot 46 formed therein. As such, ink feed slot 46 provides a supply of liquid ink to printing elements 42. Ink feed slot 46 is one embodiment of a fluid feed source. Other embodiments of fluid feed sources include but are not limited to corresponding individual ink feed holes feeding corresponding vaporization chambers and multiple shorter ink feed trenches that each feed corresponding groups of fluid ejecting elements. A thin-film structure 48 has an ink feed channel 54 formed therein which communicates with ink feed slot 46 formed in substrate 44. An orifice layer 50 has a front face 50*a* and a nozzle opening 34 formed in front face 50*a*. Orifice layer 50 also has a nozzle chamber or vaporization chamber 56 formed therein which communicates with nozzle opening 34 and ink feed channel 54 of thin-film structure 48. A firing resistor 52 is positioned within vaporization chamber 56 and leads 58 electrically couple firing resistor 52 to circuitry controlling the application of electrical current through selected firing resistors. A drop generator 60 as referred to herein includes firing resistor 52, nozzle chamber or vaporization chamber 56 and nozzle opening 34.

During printing, ink flows from ink feed slot 46 to vaporization chamber 56 via ink feed channel 54. Nozzle opening 34 is operatively associated with firing resistor 52 such that droplets of ink within vaporization chamber 56 are ejected through nozzle opening 34 (e.g., substantially normal to the plane of firing resistor 52) and toward print medium 36 upon energization of firing resistor 52.

Example embodiments of printhead dies 40 include a thermal printhead, a piezoelectric printhead, an electrostatic printhead, or any other type of fluid ejection device known in the art that can be integrated into a multi-layer structure. Substrate 44 is formed, for example, of silicon, glass, ceramic, or a stable polymer and thin-film structure 48 is formed to include one or more passivation or insulation layers of silicon dioxide, silicon carbide, silicon nitride, tantalum, polysilicon glass, or other suitable material. Thin-film structure 48, also, includes at least one conductive layer, which defines firing resistor 52 and leads 58. The conductive layer is made, for example, to include aluminum, gold, tantalum, tantalum-aluminum, or other metal or metal alloy. In one embodiment, firing cell circuitry, such as described in detail below, is implemented in substrate and thin-film layers, such as substrate 44 and thin-film structure 48.

In one embodiment, orifice layer 50 comprises a photoimageable epoxy resin, for example, an epoxy referred to as SU8, marketed by Micro-Chem, Newton, Mass. Exemplary techniques for fabricating orifice layer 50 with SU8 or other polymers are described in detail in U.S. Pat. No. 6,162,589, which is herein incorporated by reference. In one embodiment, orifice layer 50 is formed of two separate layers referred to as a barrier layer (e.g., a dry film photo resist barrier layer) and a metal orifice layer (e.g., a nickel, copper, iron/nickel alloys, palladium, gold, or rhodium layer) formed over the barrier layer. Other suitable materials, however, can be employed to form orifice layer 50.

Figure 3:
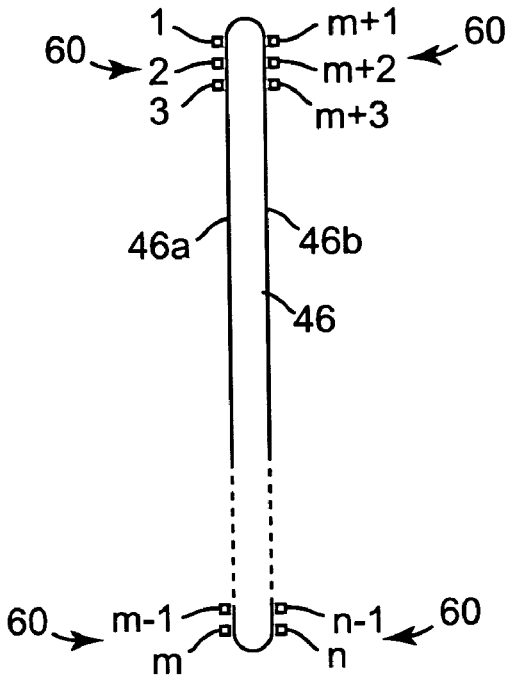
FIG. 3 is a diagram illustrating a layout of drop generators located along an ink feed slot in one embodiment of a printhead die.

FIG. 3 is a diagram illustrating drop generators 60 located along ink feed slot 46 in one embodiment of printhead die 40. Ink feed slot 46 includes opposing ink feed slot sides 46*a* and 46*b*. Drop generators 60 are disposed along each of the opposing ink feed slot sides 46*a* and 46*b*. A total of n drop generators 60 are located along ink feed slot 46, with m drop generators 60 located along ink feed slot side 46*a*, and n-m drop generators 60 located along ink feed slot side 46*b*. In one embodiment, n equals 200 drop generators 60 located along ink feed slot 46 and m equals 100 drop generators 60 located along each of the opposing ink feed slot sides 46*a* and 46*b*. In other embodiments, any suitable number of drop generators 60 can be disposed along ink feed slot 46.

Ink feed slot 46 provides ink to each of the n drop generators 60 disposed along ink feed slot 46. Each of the n drop generators 60 includes a firing resistor 52, a vaporization chamber 56 and a nozzle 34. Each of the n vaporization chambers 56 is fluidically coupled to ink feed slot 46 through at least one ink feed channel 54. The firing resistors 52 of drop generators 60 are energized in a controlled sequence to eject fluid from vaporization chambers 56 and through nozzles 34 to print an image on print medium 36.

Figure 4:
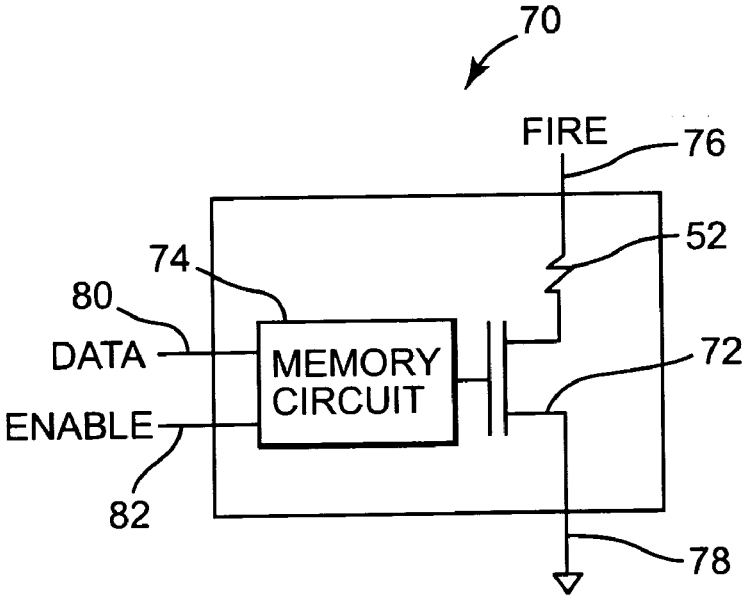
FIG. 4 is a diagram illustrating one embodiment of a firing cell employed in one embodiment of a printhead die.

FIG. 4 is a diagram illustrating one embodiment of a firing cell 70 employed in one embodiment of printhead die 40. Firing cell 70 includes a firing resistor 52, a resistor drive switch 72, and a memory circuit 74. Firing resistor 52 is part of a drop generator 60. Drive switch 72 and memory circuit 74 are part of the circuitry that controls the application of electrical current through firing resistor 52. Firing cell 70 is formed in thin-film structure 48 and on substrate 44.

In one embodiment, firing resistor 52 is a thin-film resistor and drive switch 72 is a field effect transistor (FET). Firing resistor 52 is electrically coupled to a fire line 76 and the drain-source path of drive switch 72. The drain-source path of drive switch 72 is also electrically coupled to a reference line 78 that is coupled to a reference voltage, such as ground. The gate of drive switch 72 is electrically coupled to memory circuit 74 that controls the state of drive switch 72.

Memory circuit 74 is electrically coupled to a data line 80 and enable lines 82. Data line 80 receives a data signal that represents part of an image and enable lines 82 receive enable signals to control operation of memory circuit 74. Memory circuit 74 stores one bit of data as it is enabled by the enable signals. The logic level of the stored data bit sets the state (e.g., on or off, conducting or non-conducting) of drive switch 72. The enable signals can include one or more select signals and one or more address signals.

Fire line 76 receives an energy signal comprising energy pulses and provides an energy pulse to firing resistor 52. In one embodiment, the energy pulses are provided by electronic controller 30 to have timed starting times and timed duration, resulting in timed end times, to provide a proper amount of energy to heat and vaporize fluid in the vaporization chamber 56 of a drop generator 60. If drive switch 72 is on (conducting), the energy pulse heats firing resistor 52 to heat and eject fluid from drop generator 60. If drive switch 72 is off (non-conducting), the energy pulse does not heat firing resistor 52 and the fluid remains in drop generator 60.

Figure 5:
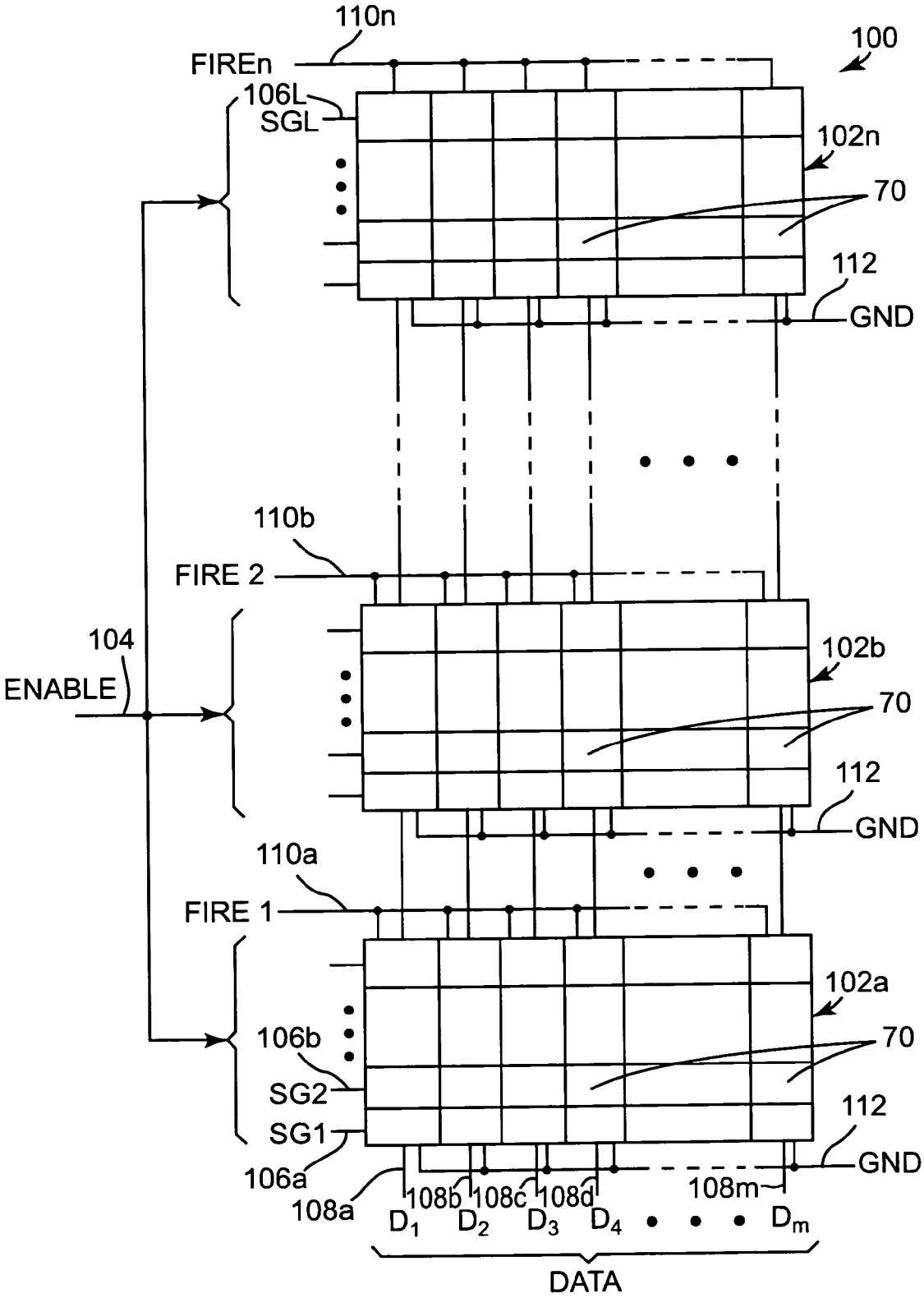
FIG. 5 is a schematic diagram illustrating one embodiment of an inkjet printhead firing cell array.

FIG. 5 is a schematic diagram illustrating one embodiment o f an inkjet printhead firing cell array 100. Firing cell array 100 includes a plurality of firing cells 70 arranged into n fire groups 102*a*-102*n*. In one embodiment, firing cells 70 are arranged into six fire groups 102*a*-102*n*. In other embodiments, firing cells 70 can be arranged into any suitable number of fire groups 102*a*-102*n*, such as four or more fire groups 102*a*-102*n*.

The firing cells 70 in array 100 are schematically arranged into L rows and m columns. The L rows of firing cells 70 are electrically coupled to enable lines 104 that receive enable signals. Each row of firing cells 70, referred to herein as a row subgroup or subgroup of firing cells 70, is electrically coupled to one set of subgroup enable lines 106*a*-106L. The subgroup enable lines 106*a*-106L receive subgroup enable signals SG1, SG2, . . . $SG_L$ that enable the corresponding subgroup of firing cells 70.

The m columns are electrically coupled to m data lines 108*a*-108*m* that receive data signals D1, D2 . . . Dm, respectively. Each of the m columns includes firing cells 70 in each of the n fire groups 102*a*-102*n* and each column of firing cells 70, referred to herein as a data line group or data group, is electrically coupled to one of the data lines 108*a*-108*m*. In other words, each of the data lines 108*a*-108*m* is electrically coupled to each of the firing cells 70 in one column, including firing cells 70 in each of the fire groups 102*a*-102*n*. For example, data line 108*a* is electrically coupled to each of the firing cells 70 in the far left column, including firing cells 70 in each of the fire groups 102*a*-102*n*. Data line 108*b* is electrically coupled to each of the firing cells 70 in the adjacent column and so on, over to and including data line 108*m* that is electrically coupled to each of the firing cells 70 in the far right column, including firing cells 70 in each of the fire groups 102*a*-102*n*.

In one embodiment, array 100 is arranged into six fire groups 102*a*-102*n* and each of the six fire groups 102*a*-102*n* includes 13 subgroups and eight data line groups. In other embodiments, array 100 can be arranged into any suitable number of fire groups 102*a*-102*n* and into any suitable number of subgroups and data line groups. In any embodiment, fire groups 102*a*-102*n* are not limited to having the same number of subgroups and data line groups. Instead, each of the fire groups 102*a*-102*n* can have a different number of subgroups and/or data line groups as compared to any other fire group 102*a*-102*n*. In addition, each subgroup can have a different number of firing cells 70 as compared to any other subgroup, and each data line group can have a different number of firing cells 70 as compared to any other data line group.

The firing cells 70 in each of the fire groups 102*a*-102*n* are electrically coupled to one of the fire lines 110*a*-110*n*. In fire group 102*a*, each of the firing cells 70 is electrically coupled to fire line 110*a* that receives fire signal or energy signal FIRE1. In fire group 102*b*, each of the firing cells 70 is electrically coupled to fire line 110*b* that receives fire signal or energy signal FIRE2 and so on, up to and including fire group 102*n* wherein each of the firing cells 70 is electrically coupled to fire line 110*n* that receives fire signal or energy signal FIREn. In addition, each of the firing cells 70 in each of the fire groups 102*a*-102*n* is electrically coupled to a common reference line 112 that is tied to ground.

In operation, subgroup enable signals SG1, SG2, . . . $SG_L$ are provided on subgroup enable lines 106*a*-106L to enable one subgroup of firing cells 70. The enabled firing cells 70 store data signals D1, D2 . . . Dm provided on data lines 108*a*-108*m*. The data signals D1, D2 . . . Dm are stored in memory circuits 74 of enabled firing cells 70. Each of the stored data signals D1, D2 . . . Dm sets the state of drive switch 72 in one of the enabled firing cells 70. The drive switch 72 is set to conduct or not conduct based on the stored data signal value.

After the states of the selected drive switches 72 are set, an energy signal FIRE1-FIREn is provided on the fire line 110*a*-110*n* corresponding to the fire group 102*a*-102*n* that includes the selected subgroup of firing cells 70. The energy signal FIRE1-FIREn includes an energy pulse. The energy pulse is provided on the selected fire line 110*a*-110*n* to energize firing resistors 52 in firing cells 70 that have conducting drive switches 72. The energized firing resistors 52 heat and eject ink onto print medium 36 to print an image represented by data signals D1, D2 . . . Dm. The process of enabling a subgroup of firing cells 70, storing data signals D1, D2 . . . Dm in the enabled subgroup and providing an energy signal FIRE1-FIREn to energize firing resistors 52 in the enabled subgroup continues until printing stops.

In one embodiment, as an energy signal FIRE1-FIREn is provided to a selected fire group 102*a*-102*n*, subgroup enable signals SG1, SG2, . . . $SG_L$ change to select and enable another subgroup in a different fire group 102*a*-102*n*. The newly enabled subgroup stores data signals D1, D2 . . . Dm provided on data lines 108*a*-108*m* and an energy signal FIRE1-FIREn is provided on one of the fire lines 110*a*-110*n* to energize firing resistors 52 in the newly enabled firing cells 70. At any one time, only one subgroup of firing cells 70 is enabled by subgroup enable signals SG1, SG2, . . . $SG_L$ to store data signals D1, D2 . . . Dm provided on data lines 108*a*-108*m*. In this aspect, data signals D1, D2 . . . Dm on data lines 108*a*-108*m* are timed division multiplexed data signals. Also, only one subgroup in a selected fire group 102*a*-102*n* includes drive switches 72 that are set to conduct while an energy signal FIRE1-FIREn is provided to the selected fire group 102*a*-102*n*. However, energy signals FIRE1-FIREn provided to different fire groups 102*a*-102*n* can and do overlap.

Figure 6:
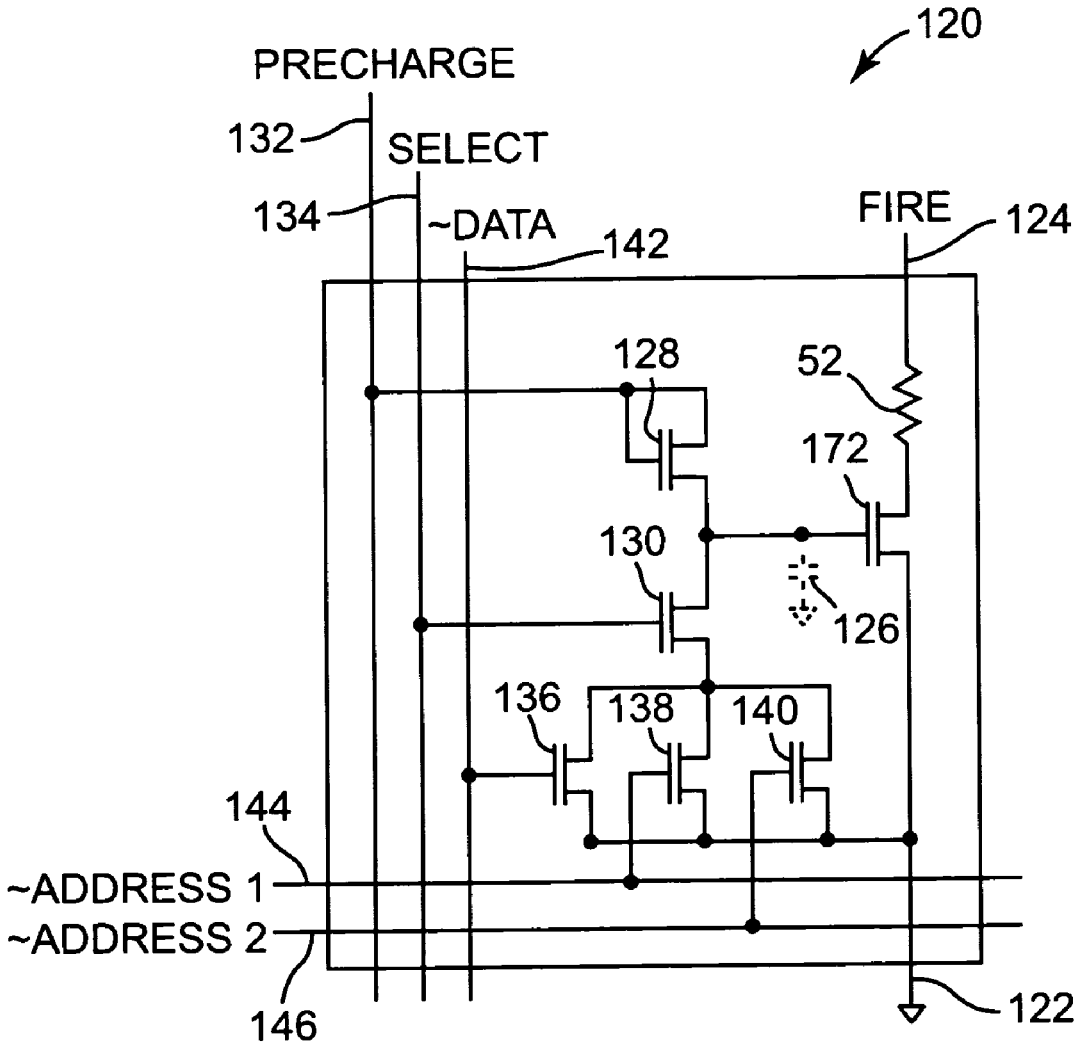
FIG. 6 is a schematic diagram illustrating one embodiment of a pre-charged firing cell.

FIG. 6 is a schematic diagram illustrating one embodiment of a pre-charged firing cell 120. The pre-charged firing cell 120 includes a drive switch 172 electrically coupled to a firing resistor 52. In one embodiment, drive switch 172 is a FET including a drain-source path electrically coupled at one end to one terminal of firing resistor 52 and at the other end to a reference line 122. The reference line 122 is tied to a reference voltage, such as ground. The other terminal of firing resistor 52 is electrically coupled to a fire line 124 that receives a fire signal or energy signal FIRE including energy pulses. The energy pulses energize firing resistor 52 if drive switch 172 is on (conducting).

The gate of drive switch 172 forms a storage node capacitance 126 that functions as a memory element to store data pursuant to the sequential activation of a pre-charge transistor 128 and a select transistor 130. The storage node capacitance 126 is shown in dashed lines, as it is part of drive switch 172. Alternatively, a capacitor separate from drive switch 172 can be used as a memory element.

The drain-source path and gate of pre-charge transistor 128 are electrically coupled to a pre-charge line 132 that receives a pre-charge signal. The gate of drive switch 172 is electrically coupled to the drain-source path of pre-charge transistor 128 and the drain-source path of select transistor 130. The gate of select transistor 130 is electrically coupled to a select line 134 that receives a select signal. A pre-charge signal is one type of pulsed charge control signal. Another type of pulsed charge control signal is a discharge signal employed in embodiments of a discharged firing cell.

A data transistor 136, a first address transistor 138 and a second address transistor 140 include drain-source paths that are electrically coupled in parallel. The parallel combination of data transistor 136, first address transistor 138 and second address transistor 140 is electrically coupled between the drain-source path of select transistor 130 and reference line 122. The serial circuit including select transistor 130 coupled to the parallel combination of data transistor 136, first address transistor 138 and second address transistor 140 is electrically coupled across node capacitance 126 of drive switch 172. The gate of data transistor 136 is electrically coupled to data line 142 that receives data signals ~DATA. The gate of first address transistor 138 is electrically coupled to an address line 144 that receives address signals ~ADDRESS1 and the gate of second address transistor 140 is electrically coupled to a second address line 146 that receives address signals ~ADDRESS2. The data signals ~DATA and address signals ~ADDRESS1 and ~ADDRESS2 are active when low as indicated by the tilda (~) at the beginning of the signal name. The node capacitance 126, pre-charge transistor 128, select transistor 130, data transistor 136 and address transistors 138 and 140 form a memory cell.

In operation, node capacitance 126 is pre-charged through pre-charge transistor 128 by providing a high level voltage pulse on pre-charge line 132. In one embodiment, after the high level voltage pulse on pre-charge line 132, a data signal ~DATA is provided on data line 142 to set the state of data transistor 136 and address signals ~ADDRESS1 and ~ADDRESS2 are provided on address lines 144 and 146 to set the states of first address transistor 138 and second address transistor 140. A high level voltage pulse is provided on select line 134 to turn on select transistor 130 and node capacitance 126 discharges if data transistor 136, first address transistor 138 and/or second address transistor 140 is on. Alternatively, node capacitance 126 remains charged if data transistor 136, first address transistor 138 and second address transistor 140 are all off.

Pre-charged firing cell 120 is an addressed firing cell if both address signals ~ADDRESS1 and ~ADDRESS2 are low and node capacitance 126 either discharges if data signal ~DATA is high or remains charged if data signal ~DATA is low. Pre-charged firing cell 120 is not an addressed firing cell if at least one of the address signals ~ADDRESS1 and ~ADDRESS2 is high and node capacitance 126 discharges regardless of the data signal ~DATA voltage level. The first and second address transistors 136 and 138 comprise an address decoder, and data transistor 136 controls the voltage level on node capacitance 126 if pre-charged firing cell 120 is addressed.

Figure 7:
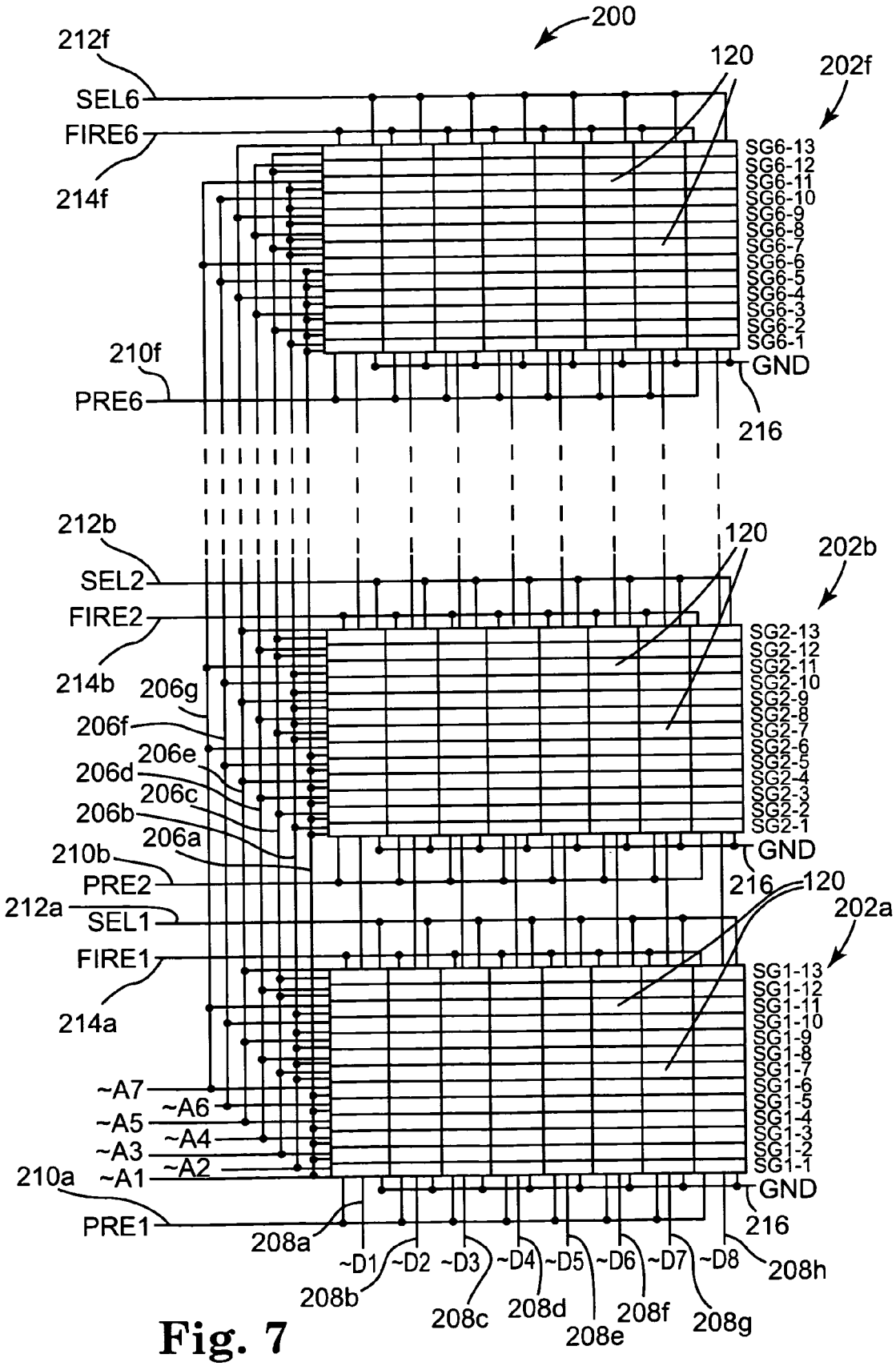
FIG. 7 is a schematic diagram illustrating one embodiment of an inkjet printhead firing cell array.

FIG. 7 is a schematic diagram illustrating one embodiment of an inkjet printhead firing cell array 200. Firing cell array 200 includes a plurality of pre-charged firing cells 120 arranged into six-fire groups 202*a*-202*f*. The pre-charged firing cells 120 in each fire group 202*a*-202*f* are schematically arranged into 13 rows and eight columns. The fire groups 202*a*-202*f* and pre-charged firing cells 120 in array 200 are schematically arranged into 78 rows and eight 30 columns.

The eight columns of pre-charged firing cells 120 are electrically coupled to eight data lines 208*a*-208*h* that receive data signals ~D1, ~D2 . . . ~D8, respectively. Each of the eight columns, referred to herein as a data line group or data group, includes pre-charged firing cells 120 in each of the six fire groups 202*a*-202*f*. Each of the firing cells 120 in each column of pre-charged firing cells 120 is electrically coupled to one of the data lines 208*a*-208*h*. All pre-charged firing cells 120 in a data line group are electrically coupled to the same data line 208*a*-208*h* that is electrically coupled to the gates of the data transistors 136 in the pre-charged firing cells 120 in the column. In one embodiment, each of the data signals ~D1, ~D2 . . . ~D8 represents a portion of an image. Also, in one embodiment, each of the data lines 208*a*-208*h* is electrically coupled to external control circuitry via a corresponding interface data pad.

Data line 208*a* is electrically coupled to each of the pre-charged firing cells 120 in the far left column, including pre-charged firing cells in each of the fire groups 202*a*-202*f*. Data line 208*b* is electrically coupled to each of the pre-charged firing cells 120 in the adjacent column and so on, over to and including data line 208*h* that is electrically coupled to each of the pre-charged firing cells 120 in the far right column, including pre-charged firing cells 120 in each of the fire groups 202*a*-202*f*.

The 78 rows of pre-charged firing cells 120 are electrically coupled to address lines 206*a*-206*g* that receive address signals ~A1, ~A2 . . . ~A7, respectively. Each pre-charged firing cell 120 in a row of pre-charged firing cells 120, referred to herein as a row subgroup or subgroup of pre-charged firing cells 120, is electrically coupled to two of the address lines 206*a*-206*g*. All pre-charged firing cells 120 in a row subgroup are electrically coupled to the same two address lines 206*a*-206*g*.

The subgroups of the fire groups 202*a*-202*f* are identified as subgroups SG1-1 through SG1-13 in fire group one (FG1) 202*a*, subgroups SG2-1 through SG2-13 in fire group two (FG2) 202*b* and so on, up to and including subgroups SG6-1 through SG6-13 in fire group six (FG6) 202*f*. In other embodiments, each fire group 202*a*-202*f* can include any suitable number of subgroups, such as 14 or more subgroups.

Each subgroup of pre-charged firing cells 120 is electrically coupled to two address lines 206*a*-206*g*. The two address lines 206*a*-206*g* corresponding to a subgroup are electrically coupled to the first and second address transistors 138 and 140 in all pre-charged firing cells 120 of the subgroup. One address line 206*a*-206*g* is electrically coupled to the gate of one of the first and second address transistors 138 and 140 and the other address line 206*a*-206*g* is electrically coupled to the gate of the other one of the first and second address transistors 138 and 140. The address lines 206*a*-206*g* receive address signals ~A1, ~A2 . . . ~A7 and provide the address signals ~A1, ~A2 . . . ~A7 to the subgroups of the array 200 as follows:

| Row Subgroup Address Signals | Row Subgroups |
|---|---|
| ~A1, ~A2 | SG1-1, SG2-1 . . . SG6-1 |
| ~A1, ~A3 | SG1-2, SG2-2 . . . SG6-2 |
| ~A1, ~A4 | SG1-3, SG2-3 . . . SG6-3 |
| ~A1, ~A5 | SG1-4, SG2-4 . . . SG6-4 |
| ~A1, ~A6 | SG1-5, SG2-5 . . . SG6-5 |

-continued

| Row Subgroup Address Signals | Row Subgroups |
|---|---|
| ~A1, ~A7 | SG1-6, SG2-6 . . . SG6-6 |
| ~A2, ~A3 | SG1-7, SG2-7 . . . SG6-7 |
| ~A2, ~A4 | SG1-8, SG2-8 . . . SG6-8 |
| ~A2, ~A5 | SG1-9, SG2-9 . . . SG6-9 |
| ~A2, ~A6 | SG1-10, SG2-10 . . . SG6-10 |
| ~A2, ~A7 | SG1-11, SG2-11 . . . SG6-11 |
| ~A3, ~A4 | SG1-12, SG2-12 . . . SG6-12 |
| ~A3, ~A5 | SG1-13, SG2-13 . . . SG6-13 |

In other embodiments, address lines 206*a*-206*g* are electrically coupled to subgroups of array 200 in any suitable coupling of address lines 206*a*-206*g* to subgroups to provide any suitable mapping of row subgroup address signals to row subgroups.

Subgroups of pre-charged firing cells 120 are addressed by providing address signals ~A1, ~A2 . . . ~A7 on address lines 206*a*-206*g*. In one embodiment, the address lines 206*a*-206*g* are electrically coupled to one or more address generators provided on printhead die 40. In other embodiments, the address lines 206*a*-206*g* are electrically coupled to external control circuitry by interface pads.

Pre-charge lines 210*a*-210*f* receive pre-charge signals PRE1, PRE2 . . . PRE6 and provide the pre-charge signals PRE1, PRE2 . . . PRE6 to corresponding fire groups 202*a*-202*f*. Pre-charge line 210*a* is electrically coupled to all of the pre-charged firing cells 120 in FG1 202*a*. Pre-charge line 210*b* is electrically coupled to all pre-charged firing cells 120 in FG2 202*b* and so on, up to and including pre-charge line 210*f* that is electrically coupled to all pre-charged firing cells 120 in FG6 202*f*. Each of the pre-charge lines 210*a*-210*f* is electrically coupled to the gate and drain-source path of all of the pre-charge transistors 128 in the corresponding fire group 202*a*-202*f*, and all pre-charged firing cells 120 in a fire group 202*a*-202*f* are electrically coupled to only one pre-charge line 210*a*-210*f*. Thus, the node capacitances 126 of all pre-charged firing cells 120 in a fire group 202*a*-202*f* are charged by providing the corresponding pre-charge signal PRE1, PRE2 . . . PRE6 to the corresponding pre-charge line 210*a*-210*f*. In one embodiment, each of the pre-charge lines 210*a*-210*f* is electrically coupled to external control circuitry via a corresponding interface pad.

Select lines 212*a*-212*f* receive select signals SEL1, SEL2 . . . SEL6 and provide the select signals SEL1, SEL2 . . . SEL6 to corresponding fire groups 202*a*-202*f*. Select line 212*a* is electrically coupled to all pre-charged firing cells 120 in FG1 202*a*. Select line 212*b* is electrically coupled to all pre-charged firing cells 120 in FG2 202*b* and so on, up to and including select line 212*f* that is electrically coupled to all pre-charged firing cells 120 in FG6 202*f*. Each of the select lines 212*a*-212*f* is electrically coupled to the gate of all of the select transistors 130 in the corresponding fire group 202*a*-202*f*, and all pre-charged firing cells 120 in a fire group 202*a*-202*f* are electrically coupled to only one select line 212*a*-212*f*. In one embodiment, each of the select lines 212*a*-212*f* is electrically coupled to external control circuitry via a corresponding interface pad. Also, in one embodiment, some of the pre-charge lines 210*a*-210*f* and some of the select lines 212*a*-212*f* are electrically coupled together to share interface pads.

Fire lines 214*a*-214*f* receive fire signals or energy signals FIRE1, FIRE2 . . . FIRE6 and provide the energy signals FIRE1, FIRE2 . . . FIRE6 to corresponding fire groups 202*a*-202*f*. Fire line 214*a* is electrically coupled to all pre-charged firing cells 120 in FG1 202*a*. Fire line 214*b* is electrically coupled to all pre-charged firing cells 120 in FG2 202*b* and so on, up to and including fire line 214*f* that is electrically coupled to all pre-charged firing cells 120 in FG6 202*f*. Each of the fire lines 214*a*-214*f* is electrically coupled to all of the firing resistors 52 in the corresponding fire group 202*a*-202*f*, and all pre-charged firing cells 120 in a fire group 202*a*-202*f* are electrically coupled to only one fire line 214*a*-214*f*. The fire lines 214*a*-214*f* are electrically coupled to external supply circuitry by appropriate interface pads. All pre-charged firing cells 120 in array 200 are electrically coupled to a reference line 216 that is tied to a reference voltage, such as ground. Thus, the pre-charged firing cells 120 in a row subgroup of pre-charged firing cells 120 are electrically coupled to the same address lines 206*a*-206*g*, pre-charge line 210*a*-210*f*, select line 212*a*-212*f* and fire line 214*a*-214*f*.

In operation, in one embodiment fire groups 202*a*-202*f* are selected to fire in succession. FG1 202*a* is selected before FG2 202*b*, which is selected before FG3 and so on, up to FG6 202*f*. After FG6 202*f*, the fire group cycle starts over with FG1 202*a*.

The address signals ~A1, ~A2 . . . ~A7 cycle through the 13 row subgroup addresses before repeating a row subgroup address. The address signals ~A1, ~A2 . . . ~A7 provided on address lines 206*a*-206*g* are set to one row subgroup address during each cycle through the fire groups 202*a*-202*f*. The address signals ~A1 ~A2 . . . ~A7 select one row subgroup in each of the fire groups 202*a*-202*f* for one cycle through the fire groups 202*a*-202*f*. For the next cycle through fire groups 202*a*-202*f*, the address signals ~A1, ~A2 . . . ~A7 are changed to select another row subgroup in each of the fire groups 202*a*-202*f*. This continues up to the address signals ~A1, ~A2 . . . ~A7 selecting the last row subgroup in fire groups 202*a*-202*f*. After the last row subgroup, address signals ~A1, ~A2 . . . ~A7 select the first row subgroup to begin the address cycle over again.

In another aspect of operation, one of the fire groups 202*a*-202*f* is operated by providing a pre-charge signal PRE1, PRE2 . . . PRE6 on the pre-charge line 210*a*-210*f* of the one fire group 202*a*-202*f*. The pre-charge signal PRE1, PRE2 . . . PRE6 defines a pre-charge time interval or period during which time the node capacitance 126 on each drive switch 172 in the one fire group 202*a*-202*f* is charged to a high voltage level, to pre-charge the one fire group 202*a*-202*f*.

Address signals ~A1, ~A2 . . . ~A7 are provided on address lines 206*a*-206*g* to address one row subgroup in each of the fire groups 202*a*-202*f*, including one row subgroup in the pre-charged fire group 202*a*-202*f*. Data signals ~D1, ~D2 . . . ~D8 are provided on data lines 208*a*-208*h* to provide data to all fire groups 202*a*-202*f*, including the addressed row subgroup in the pre-charged fire group 202*a*-202*f*.

Next, a select signal SEL1, SEL2 . . . SEL6 is provided on the select line 212*a*-212*f* of the pre-charged fire group 202*a*-202*f* to select the pre-charged fire group 202*a*-202*f*. The select signal SEL1, SEL2 . . . SEL6 defines a discharge time interval for discharging the node capacitance 126 on each drive switch 172 in a pre-charged firing cell 120 that is either not in the addressed row subgroup in the selected fire group 202*a*-202*f* or addressed in the selected fire group 202*a*-202*f* and receiving a high level data signal ~D1, ~D2 . . . ~D8. The node capacitance 126 does not discharge in pre-charged firing cells 120 that are addressed in the selected fire group 202*a*-202*f* and receiving a low level data signal ~D1, ~D2 . . . ~D8. A high voltage level on the node capacitance 126 turns the drive switch 172 on (conducting).

After drive switches 172 in the selected fire group 202*a*-202*f* are set to conduct or not conduct, an energy pulse or voltage pulse is provided on the fire line 214*a*-214*f* of the selected fire group 202*a*-202*f*. Pre-charged firing cells 120 that have conducting drive switches 172, conduct current through the firing resistor 52 to heat ink and eject ink from the corresponding drop generator 60.

With fire groups 202*a*-202*f* operated in succession, the select signal SEL1, SEL2 . . . SEL6 for one fire group 202*a*-202*f* is used as the pre-charge signal PRE1, PRE2 . . . PRE6 for the next fire group 202*a*-202*f*. The pre-charge signal PRE1, PRE2. . . PRE6 for one fire group 202*a*-202*f* precedes the select signal SEL1, SEL2 . . . SEL6 and energy signal FIRE1, FIRE2 . . . FIRE6 for the one fire group 202*a*-202*f*. After the pre-charge signal PRE1, PRE2 . . . PRE6, data signals ~D1, ~D2 . . . ~D8 are multiplexed in time and stored in the addressed row subgroup of the one fire group 202*a*-202*f* by the select signal SEL1, SEL2 . . . SEL6. The select signal SEL1, SEL2 . . . SEL6 for the selected fire group 202*a*-202*f* is also the pre-charge signal PRE1, PRE2 . . . PRE6 for the next fire group 202*a*-202*f*. After the select signal SEL1, SEL2 . . . SEL6 for the selected fire group 202*a*-202*f* is complete, the select signal SEL1, SEL2 . . . SEL6 for the next fire group 202*a*-202*f* is provided. Pre-charged firing cells 120 in the selected subgroup fire or heat ink based on the stored data signal ~D1, ~D2 . . . ~D8 as the energy signal FIRE1, FIRE2 . . . FIRE6, including an energy pulse, is provided to the selected fire group 202*a*-202*f*.

Figure 8:
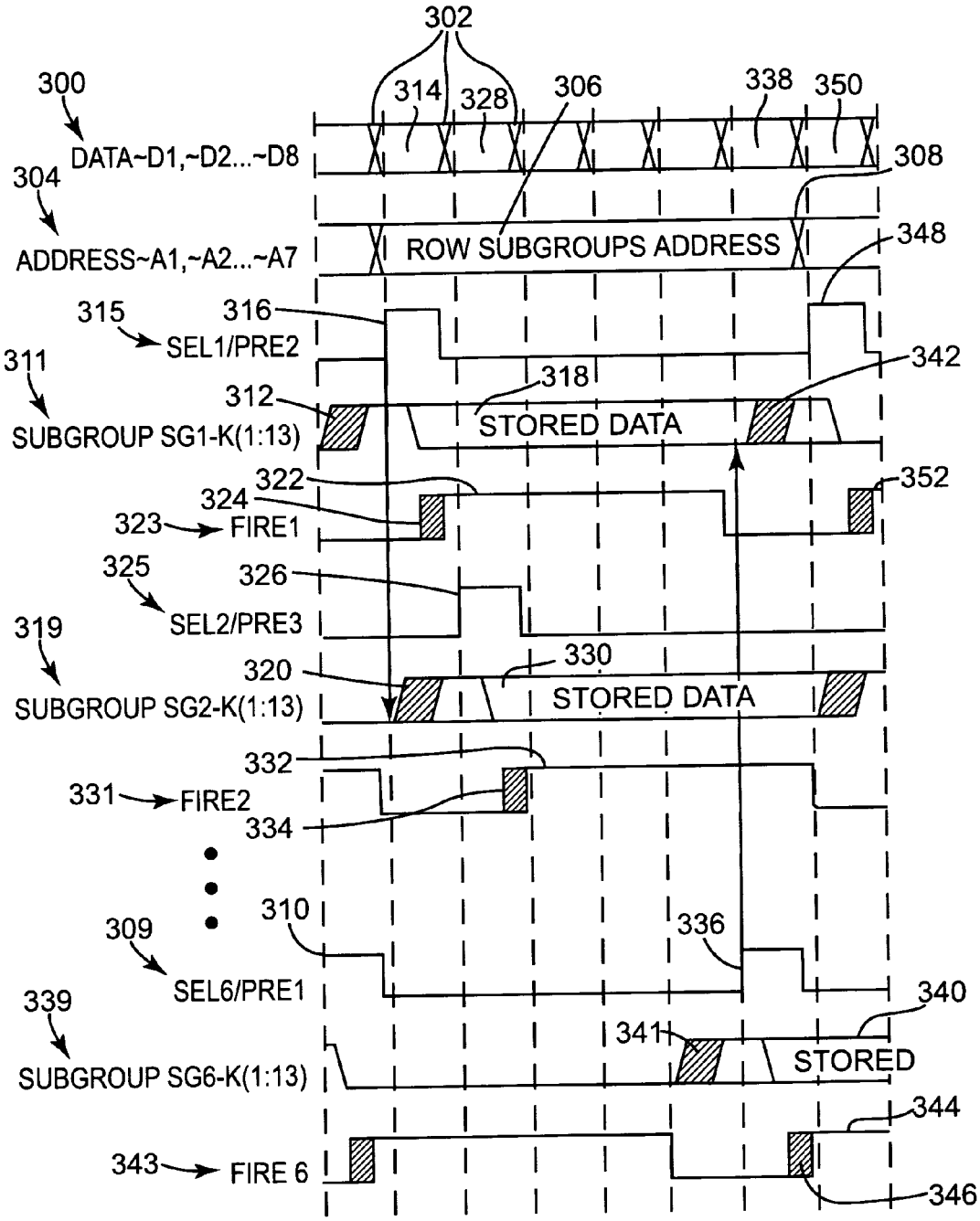
FIG. 8 is a timing diagram illustrating the operation of one embodiment of a firing cell array.

FIG. 8 is a timing diagram illustrating the operation of one embodiment of firing cell array 200. Fire groups 202*a*-202*f* are selected in succession to energize pre-charged firing cells 120 based on data signals ~D1, ~D2 . . . ~D8, indicated at 300. The data signals ~D1, ~D2 . . . ~D8 at 300 are changed as needed, indicated at 302, for each row subgroup address and fire group 202*a*-202*f* combination. Address signals ~A1, ~A2 . . . ~A7 at 304 are provided on address lines 206*a*-206*g* to address one row subgroup from each of the fire groups 202*a*-202*f*. The address signals ~A1, ~A2 . . . ~A7 at 304 are set to one address, indicated at 306, for one cycle through fire groups 202*a*-202*f*. After the cycle is complete, the address signals ~A1, ~A2 . . . ~A7 at 304 are changed at 308 to address a different row subgroup from each of the fire groups 202*a*-202*f*. The address signals ~A1, ~A2 . . . ~A7 at 304 increment through the row subgroups to address the row subgroups in sequential order from one to 13 and back to one. In other embodiments, address signals ~A1, ~A2 . . . ~A7 at 304 can be set to address row subgroups in any suitable order.

During a cycle through fire groups 202*a*-202*f*, select line 212*f* coupled to FG6 202*f* and pre-charge line 210*a* coupled to FG1 202*a* receive SEL6/PRE1 signal 309, including SEL6/PRE1 signal pulse 310. In one embodiment, the select line 212*f* and pre-charge line 210*a* are electrically coupled together to receive the same signal. In another embodiment, the select line 212*f* and pre-charge line 210*a* are not electrically coupled together, but receive similar signals.

The SEL6/PRE1 signal pulse at 310 on pre-charge line 210*a*, pre-charges all firing cells 120 in FG1 202*a*. The node capacitance 126 for each of the pre-charged firing cells 120 in FG1 202*a* is charged to a high voltage level. The node capacitances 126 for pre-charged firing cells 120 in one row subgroup SG1-K, indicated at 311, are pre-charged to a high voltage level at 312. The row subgroup address at 306 selects subgroup SG1-K, and a data signal set at 314 is provided to data transistors 136 in all pre-charged firing cells 120 of all fire groups 202*a*-202*f*, including the address selected row subgroup SG1-K.

The select line 212*a* for FG1 202*a* and pre-charge line 210*b* for FG2 202*b* receive the SEL1/PRE2 signal 315, including the SEL1/PRE2 signal pulse 316. The SEL1/PRE2 signal pulse 316 on select line 212*a* turns on the select transistor 130 in each of the pre-charged firing cells 120 in FG1 202*a*. The node capacitance 126 is discharged in all pre-charged firing cells 120 in FG1 202*a* that are not in the address selected row subgroup SG1-K. In the address selected row subgroup SG1-K, data at 314 are stored, indicated at 318, in the node capacitances 126 of the drive switches 172 in row subgroup SG1-K to either turn the drive switch on (conducting) or off (non-conducting).

The SEL1/PRE2 signal pulse at 316 on pre-charge line 210*b*, pre-charges all firing cells 120 in FG2 202*b*. The node capacitance 126 for each of the pre-charged firing cells 120 in FG2 202*b* is charged to a high voltage level. The node capacitances 126 for pre-charged firing cells 120 in one row subgroup SG2-K, indicated at 319, are pre-charged to a high voltage level at 320. The row subgroup address at 306 selects subgroup SG2-K, and a data signal set at 328 is provided to data transistors 136 in all pre-charged firing cells 120 of all fire groups 202*a*-202*f*, including the address selected row subgroup SG2-K.

The fire line 214*a* receives energy signal FIRE1, indicated at 323, including an energy pulse at 322 to energize firing resistors 52 in pre-charged firing cells 120 that have conductive drive switches 172 in FG1 202*a*. The FIRE1 energy pulse 322 goes high while the SEL1/PRE2 signal pulse 316 is high and while the node capacitance 126 on non-conducting drive switches 172 are being actively pulled low, indicated on energy signal FIRE1 323 at 324. Switching the energy pulse 322 high while the node capacitances 126 are actively pulled low, prevents the node capacitances 126 from being inadvertently charged through the drive switch 172 as the energy pulse 322 goes high. The SEL1/PRE2 signal 315 goes low and the energy pulse 322 is provided to FG1 202*a* for a predetermined time to heat ink and eject the ink through nozzles 34 corresponding to the conducting pre-charged firing cells 120.

The select line 212*b* for FG2 202*b* and pre-charge line 210*c* for FG3 202*c* receive SEL2/PRE3 signal 325, including SEL2/PRE3 signal pulse 326. After the SEL1/PRE2 signal pulse 316 goes low and while the energy pulse 322 is high, the SEL2/PRE3 signal pulse 326 on select line 212*b* turns on select transistor 130 in each of the pre-charged firing cells 120 in FG2 202*b*. The node capacitance 126 is discharged on all pre-charged firing cells 120 in FG2 202*b* that are not in the address selected row subgroup SG2-K. Data signal set 328 for subgroup SG2-K is stored in the pre-charged firing cells 120 of subgroup SG2-K, indicated at 330, to either turn the drive switches 172 on (conducting) or off (non-conducting). The SEL2/PRE3 signal pulse on pre-charge line 210*c* pre-charges all pre-charged firing cells 120 in FG3 202*c*.

Fire line 214*b* receives energy signal FIRE2, indicated at 331, including energy pulse 332, to energize firing resistors 52 in pre-charged firing cells 120 of FG2 202*b* that have conducting drive switches 172. The FIRE2 energy pulse 332 goes high while the SEL2/PRE3 signal pulse 326 is high, indicated at 334. The SEL2/PRE3 signal pulse 326 goes low and the FIRE2 energy pulse 332 remains high to heat and eject ink from the corresponding drop generator 60.

After the SEL2/PRE3 signal pulse 326 goes low and while the energy pulse 332 is high, a SEL3/PRE4 signal is provided to select FG3 202*c* and pre-charge FG4 202*d*. The process of pre-charging, selecting and providing an energy signal, including an energy pulse, continues up to and including FG6 202*f*.

The SEL5/PRE6 signal pulse on pre-charge line 210*f*, pre-charges all firing cells 120 in FG6 202*f*. The node capacitance 126 for each of the pre-charged firing cells 120 in FG6 202*f* is charged to a high voltage level. The node capacitances 126 for pre-charged firing cells 120 in one row subgroup SG6-K, indicated at 339, are pre-charged to a high voltage level at 341. The row subgroup address at 306 selects subgroup SG6-K, and data signal set 338 is provided to data transistors 136 in all pre-charged firing cells 120 of all fire groups 202*a*-202*f*, including the address selected row subgroup SG6-K.

The select line 212*f* for FG6 202*f* and pre-charge line 210*a* for FG1 202*a* receive a second SEL6/PRE1 signal pulse at 336. The second SEL6/PRE1 signal pulse 336 on select line 212*f* turns on the select transistor 130 in each of the pre-charged firing cells 120 in FG6 202*f*. The node capacitance 126 is discharged in all pre-charged firing cells 120 in FG6 202*f* that are not in the address selected row subgroup SG6-K. In the address selected row subgroup SG6-K, data 338 are stored at 340 in the node capacitances 126 of each drive switch 172 to either turn the drive switch on or off.

The SEL6/PRE1 signal on pre-charge line 210*a*, pre-charges node capacitances 126 in all firing cells 120 in FG1 202*a*, including firing cells 120 in row subgroup SG1-K, indicated at 342, to a high voltage level. The firing cells 120 in FG1 202*a* are pre-charged while the address signals ~A1, ~A2 . . . ~A7 304 select row subgroups SG1-K, SG2-K and on, up to row subgroup SG6-K.

The fire line 214*f* receives energy signal FIRE6, indicated at 343, including an energy pulse at 344 to energize fire resistors 52 in pre-charged firing cells 120 that have conductive drive switches 172 in FG6 202*f*. The energy pulse 344 goes high while the SEL6/PRE1 signal pulse 336 is high and node capacitances 126 on non-conducting drive switches 172 are being actively pulled low, indicated at 346. Switching the energy pulse 344 high while the node capacitances 126 are actively pulled low, prevents the node capacitances 126 from being inadvertently charged through drive switch 172 as the energy pulse 344 goes high. The SEL6/PRE1 signal pulse 336 goes low and the energy pulse 344 is maintained high for a predetermined time to heat ink and eject ink through nozzles 34 corresponding to the conducting pre-charged firing cells 120.

After the SEL6/PRE1 signal pulse 336 goes low and while the energy pulse 344 is high, address signals ~A1, ~A2 . . . ~A7 304 are changed at 308 to select another set of subgroups SG1-K+1, SG2-K+1 and so on, up to SG6-K+1. The select line 212*a* for FG1 202*a* and pre-charge line 210*b* for FG2 202*b* receive a SEL1/PRE2 signal pulse, indicated at 348. The SEL1/PRE2 signal pulse 348 on select line 212*a* turns on the select transistor 130 in each of the pre-charged firing cells 120 in FG1 202*a*. The node capacitance 126 is discharged in all pre-charged firing cells 120 in FG1 202*a* that are not in the address selected subgroup SG1-K+1. Data signal set 350 for row subgroup SG1-K+1 is stored in the pre-charged firing cells 120 of subgroup SG1-K+1 to either turn drive switches 172 on or off. The SEL1/PRE2 signal pulse 348 on pre-charge line 210*b* pre-charges all firing cells 120 in FG2 202*b*.

The fire line 214*a* receives energy pulse 352 to energize firing resistors 52 and pre-charged firing cells 120 of FG1 202*a* that have conducting drive switches 172. The energy pulse 352 goes high while the SEL1/PRE2 signal pulse at 348 is high. The SEL1/PRE2 signal pulse 348 goes low and the energy pulse 352 remains high to heat and eject ink from corresponding drop generators 60. The process continues until printing is complete.

Figure 9:
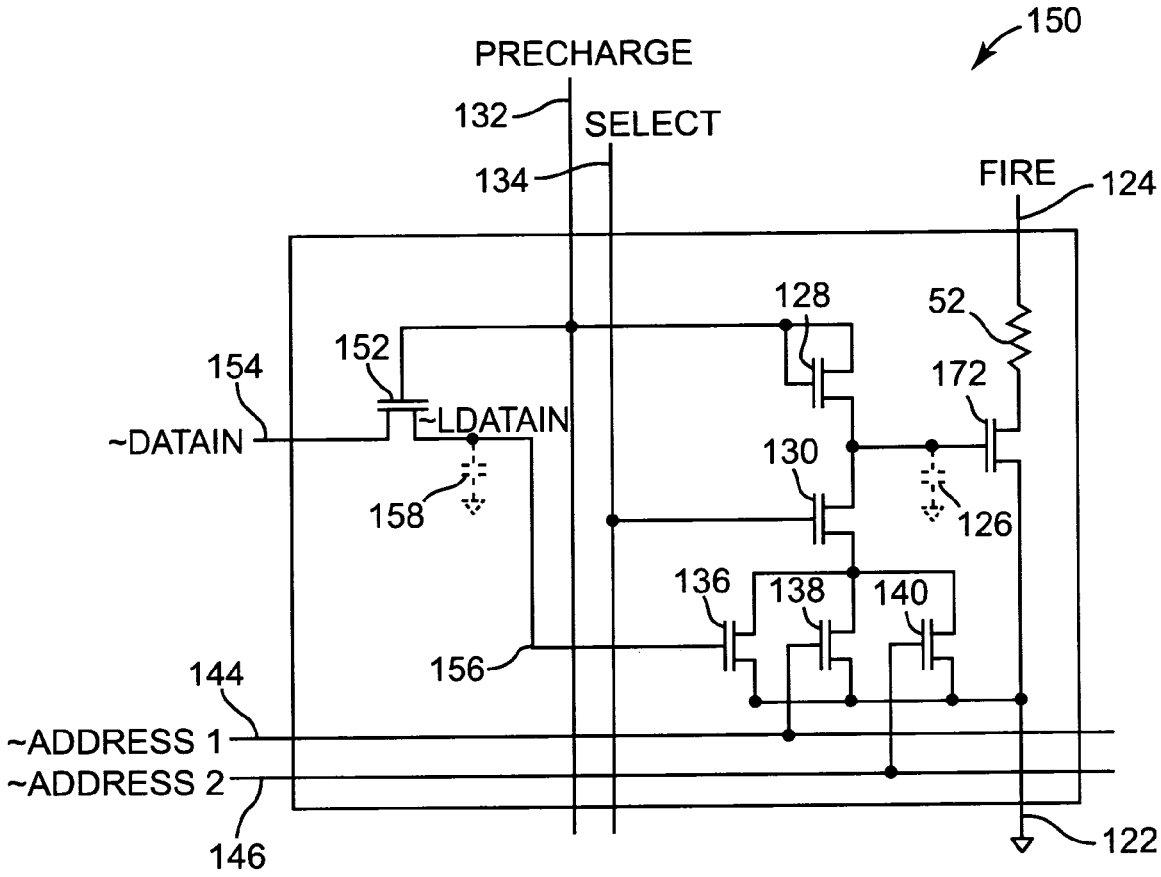
FIG. 9 is a schematic diagram illustrating one embodiment of a pre-charged firing cell configured to latch data.

FIG. 9 is a schematic diagram illustrating one embodiment of a pre-charged firing cell 150 configured to latch data. In one embodiment, pre-charged firing cell 150 is part of a current fire group that is part of an inkjet printhead firing cell array. The inkjet printhead firing cell array includes multiple fire groups.

Pre-charged firing cell 150 is similar to the pre-charged firing cell 120 of FIG. 6 and includes drive switch 172, firing resistor 52 and the memory cell of pre-charged firing cell 120. Elements of pre-charged firing cell 150 that coincide with elements of pre-charged firing cell 120 have the same numbers as the elements of pre-charged firing cell 120 and are electrically coupled together and to signal lines as described in the description of FIG. 6, with the exception that the gate of data transistor 136 is electrically coupled to latched data line 156 that receives latched data signal ~LDATAIN instead of being coupled to data line 142 that receives data signal ~DATA. In addition, elements of pre-charged firing cell 150 that coincide with elements in pre-charged firing cell 120 function and operate as described in the description of FIG. 6.

Pre-charged firing cell 150 includes a data latch transistor 152 that includes a drain-source path electrically coupled between data line 154 and latched data line 156. Data line 154 receives data signals ~DATAIN and data latch transistor 152 latches data into pre-charged firing cell 150 to provide latched data signals ~LDATAIN. Data signals ~DATAIN and latched data signals ~LDATAIN are active when low as indicated by the tilda (~) at the beginning of the signal name. The gate of data latch transistor 152 is electrically coupled to pre-charge line 132 that receives the pre-charge signal of the current fire group.

In another embodiment, the gate of data latch transistor 152 is not electrically coupled to the pre-charge line 132 of the current fire group. Instead, the gate of data latch transistor 152 is electrically coupled to a different signal line that provides a pulsed signal, such as a pre-charge line of another fire group.

In one embodiment, the data latch transistor 152 is a minimum sized transistor to minimize charge sharing between the latched data line 156 and the gate to source node of data latch transistor 152 as the pre-charge signal transitions from a high voltage level to allow voltage level. This charge sharing reduces high voltage level latched data. Also, in one embodiment, the drain of the data latch transistor 152 determines the capacitance seen at data line 154 when the pre-charge signal is at a low voltage level and a minimum sized transistor keeps this capacitance low.

Data latch transistor 152 passes data from data line 154 to latched data line 156 and a latched data storage node capacitance 158 via a high level pre-charge signal. The data is latched onto the latched data line 154 and the latched data storage node capacitance 158 as the pre-charge signal transitions from a high level to a low level. The latched data storage node capacitance 158 is shown in dashed lines, as it is part of data transistor 136. Alternatively, a capacitor separate from data transistor 136 can be used to store latched data.

The latched data storage node capacitance 158 is large enough to remain at substantially a high level as the pre-charge signal transitions from a high level to a low level. Also, the latched data storage node capacitance 158 is large enough to remain at substantially a low level as an energy pulse is provided via the fire signal FIRE and a high voltage pulse is provided in select signal SELECT. In addition, data transistor 136 is small enough to maintain a low level on the latched data storage node capacitance 158 as the gate of drive switch 172 is discharged and large enough to fully discharge the gate of drive switch 172 before the beginning of an energy pulse in the fire signal FIRE.

In one embodiment, multiple pre-charged firing cells use the same data and share the same data latch transistor 152 and latched data signal ~LDATAIN at 156. The latched data signal ~LDATAIN at 156 is latched once and used by the multiple pre-charged firing cells. This increases the capacitance on any individual latched data line 156 making it less susceptible to switching problems and reduces the total capacitance driven via data line 154.

In operation, data signal ~DATAIN is received by data line 154 and passed to latched data line 156 and latched data storage node capacitance 158 via data latch transistor 152 by providing a high level voltage pulse on pre-charge line 132. Also, storage node capacitance 126 is pre-charged through pre-charge transistor 128 via the high level voltage pulse on pre-charge line 132. Data latch transistor 152 is turned off to provide latched data signals ~LDATAIN as the voltage pulse on pre-charge line 132 transitions from the high voltage level to a low level voltage. The data to be latched into pre-charged firing cell 150 is provided while the pre-charge signal is at a high voltage level and held until after the pre-charge signal transitions to a low voltage level. In contrast, the data to be latched into pre-charged firing cell 120 of FIG. 6 is provided while the select signal is at a high voltage level.

In another embodiment, the gate of data latch transistor 152 is not electrically coupled to the pre-charge line 132 of the current fire group. Instead, the gate of data latch transistor 152 is electrically coupled to a pre-charge line of another fire group. Data signal ~DATAIN is received by data line 154 and passed to latched data line 156 and latched data storage node capacitance 158 via data latch transistor 152 by providing a high level voltage pulse on the pre-charge line of the other fire group. Data latch transistor 152 is turned off to provide latched data signals ~LDATAIN as the voltage pulse on the pre-charge line of the other fire group transitions from a high voltage level to a low level voltage. Storage node capacitance 126 is pre-charged through pre-charge transistor 128 via the high level voltage pulse on pre-charge line 132. The high voltage pulse on pre-charge line 132 occurs after the transition of the voltage pulse on the pre-charge line of the other fire group from a high voltage level to a low voltage level.

In one embodiment, the gate of a data latch transistor, such as data latch transistor 152, of a first pre-charged firing cell in the current fire group is electrically coupled to a first pre-charge line of a first fire group that is different than the current fire group. Also, the gate of a data latch transistor, such as data latch transistor 152, of a second pre-charged firing cell in the current fire group is electrically coupled to a second pre-charge line of a second fire group that is different than the first fire group and the current fire group. Data line 154 provides data during the high voltage levels of the pre-charge signals of the first and second fire groups. Data latched into the first and second pre-charged firing cells is used via the pre-charge and select signals of the current fire group. In one embodiment, data line 154 is not electrically coupled to every fire group in the inkjet printhead firing cell array.

In one embodiment of pre-charge firing cell 150, after the high level voltage pulse on pre-charge line 132, address signals ~ADDRESS1 and ~ADDRESS2 are provided on address lines 144 and 146 to set the states of first address transistor 138 and second address transistor 140. A high level voltage pulse is provided on select line 134 to turn on select transistor 130 and storage node capacitance 126 discharges if data transistor 136, first address transistor 138 and/or second address transistor 140 is on. Alternatively, storage node capacitance 126 remains charged if data transistor 136, first address transistor 138 and second address transistor 140 are all off.

Pre-charged firing cell 150 is an addressed firing cell if both address signals ~ADDRESS1 and ~ADDRESS2 are low, and storage node capacitance 126 either discharges if latched data signal ~LDATAIN is high or remains charged if latched data signal ~LDATAIN is low. Pre-charged firing cell 150 is not an addressed firing cell if at least one of the address signals ~ADDRESS1 and ~ADDRESS2 is high, and storage node capacitance 126 discharges regardless of the voltage level of latched data signal ~LDATAIN. The first and second address transistors 136 and 138 comprise an address decoder and, if pre-charged firing cell 150 is addressed, data transistor 136 controls the voltage level on storage node capacitance 126.

Figure 10:
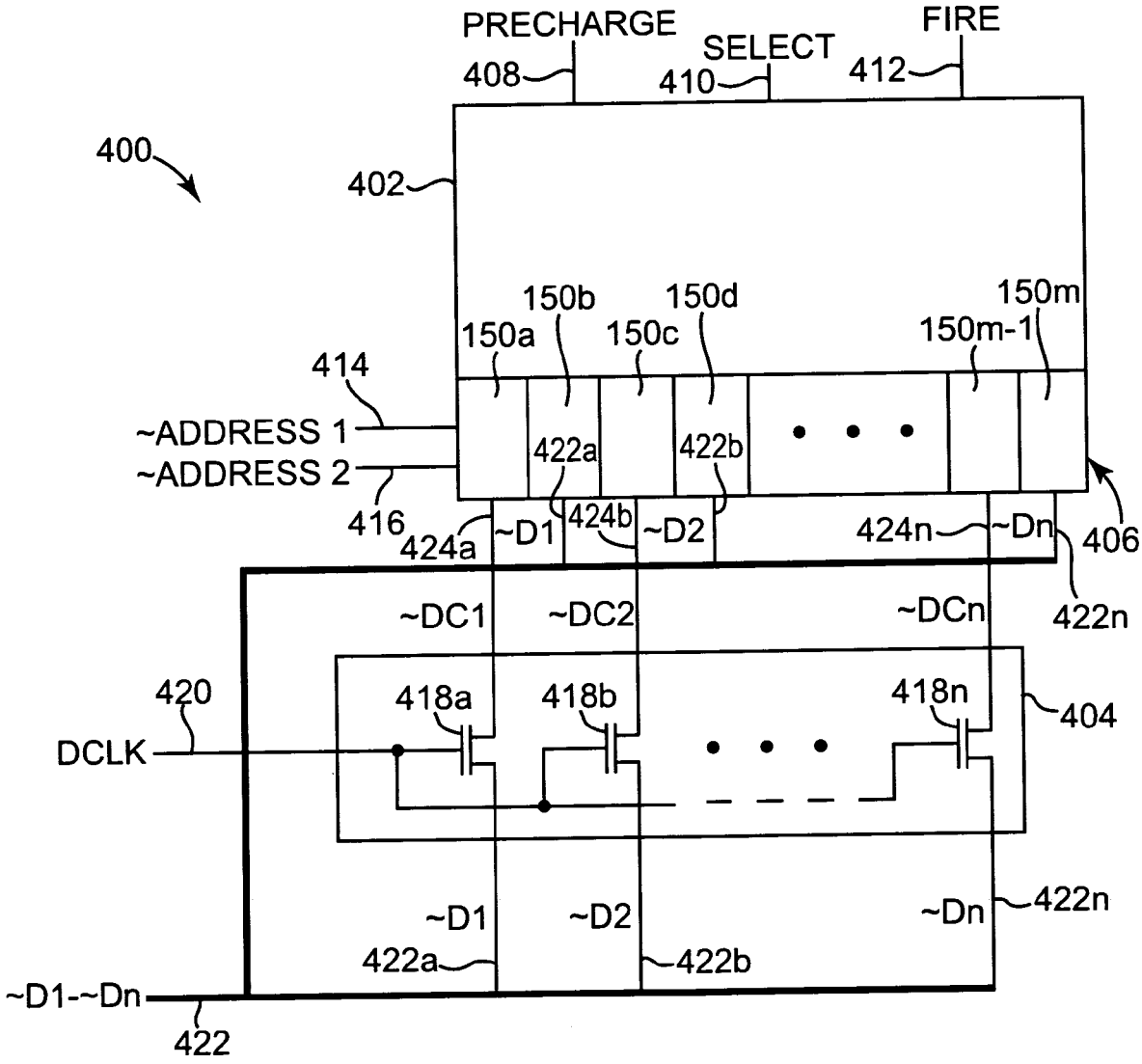
FIG. 10 is a schematic diagram illustrating one embodiment of a double data rate firing cell circuit.

FIG. 10 is a schematic diagram illustrating one embodiment of a double data rate firing cell circuit 400. The double data rate firing cell circuit 400 latches in two data bits from each of the data lines at each high voltage pulse in the pre-charge signal. Thus, twice the number of firing resistors can be energized without increasing the firing frequency or the number of input pads. The number of drop generators per input pad can be increased, such as by increasing the number of drop generators on a printhead and using the same number of input pads or using the same number of drop generators on a printhead and reducing the number of input pads. A printhead with more drop generators typically prints with higher quality and/or printing speed. Also, a printhead with fewer input pads typically costs less than a printhead with more input pads.

The double data rate firing cell circuit 400 includes a plurality of fire groups, such as fire group 402, and a clock latch circuit 404. The fire group 402 includes a plurality of pre-charged firing cells 150 that are configured to latch data and a plurality of row subgroups, such as row subgroup 406. The row subgroup 406 includes pre-charged firing cells 150*a*-150*m*.

Each of the pre-charged firing cells 150 in fire group 402 is electrically coupled to pre-charge line 408 to receive pre-charge signal PRECHARGE, select line 410 to receive select signal SELECT and fire line 412 to receive fire signal FIRE. Each of the pre-charged firing cells 150*a*-150*m* in row subgroup 406 is electrically coupled to first address line 414 to receive first address signal ~ADDRESS1 and to second address line 416 to receive second address signal ~ADDRESS2. The pre-charged firing cells 150 receive signals and operate as described in the description of FIG. 9.

Clock latch circuit 404 includes clock latch transistors 418*a*-418*n*. The gate of each of the clock latch transistors 418*a*-418*n* is electrically coupled to a clock line 420 to receive data clock signal DCLK. The drain-source path of each of the clock latch transistors 418*a*-418*n* is electrically coupled to one of the data lines 422*a*-422*n* to receive one of the data signals ~D1-~Dn, indicated at 422. The other side of the drain source path of each of the clock latch transistors 418*a*-418*n* is electrically coupled to pre-charged firing cells 150 in fire group 402 and in all the other fire groups in double data rate firing cell circuit 400 via corresponding clock data lines 424*a*-424*n*. Having all of the pre-charged firing cells 150 in one data line group electrically coupled to a single one of the clock latch transistors 418*a*-418*n* ensures that there is enough capacitance on clocked data lines 424*a*-424*n* to ensure that charge sharing by clocked data signals ~DC1-~DCn is small enough to maintain a minimum high voltage level in data latched into the pre-charged firing cells 150 as the pre-charge signal transitions to a low voltage level and as the data clock signal DCLK at 420 transitions to a low voltage level.

In other embodiments, each of the clock latch transistors 418*a*-418*n* and corresponding clock data lines 424*a*-424*n* can be split into multiple transistors and multiple data lines. In one embodiment, one of the multiple transistors that corresponds to one of the clock latch transistors 418*a*-418*n* and one of the multiple data lines that corresponds to one of the clock data lines 424*a*-424*n* is coupled to nozzles of the fire group on one side of a fluid channel. Also, another one of the multiple transistors that corresponds to the same one of the clock latch transistors 418*a*-418*n* and another one of the multiple data lines that corresponds to the same one of the clock data lines 424*a*-424*n* is coupled to nozzles of the fire group on another side of the fluid channel. In one embodiment, each nozzle can be coupled to a separate one of the multiple transistors via a separate one of the multiple data lines.

Clock latch transistor 418*a* includes a drain-source path that is electrically coupled at one end to data line 422*a* to receive data signal ~D1. The other end of the drain-source path of clock latch transistor 418*a* is electrically coupled at 424*a* to the pre-charged firing cell 150*a* and all of the pre-charged firing cells 150 in the same column or data line group as pre-charged firing cell 150*a*, including pre-charged firing cells 150 in fire group 402 and in other fire groups in double data rate firing cell circuit 400. The drain-source path of clock latch transistor 418*a* is electrically coupled to data line 154 and the drain-source path of data latch transistor 152 in each of the pre-charged firing cells 150 in the corresponding data line group. Clock latch transistor 418*a* receives data signal ~D1 at 422*a* and provides clocked data signal ~DC1 at 424*a* to the data line group that includes pre-charged firing cell 150*a*.

Data line 422*a* is also electrically coupled to the pre-charged firing cell 150*b* and all of the pre-charged firing cells 150 in the same column or data line group as pre-charged firing cell 150*b*, including pre-charged firing cells 150 in fire group 402 and in other fire groups in double data rate firing cell circuit 400. The data line 422*a* is electrically coupled to data line 154 and the drain-source path of data latch transistor 152 in each of the pre-charged firing cells 150 in the corresponding data line group. The data line group that includes pre-charged firing cell 150*b* receives data signal ~D1 at 422*a*.

Clock latch transistor 418*b* includes a drain-source path that is electrically coupled at one end to data line 422*b* to receive data signal ~D2. The other end of the drain-source path of clock latch transistor 418*b* is electrically coupled at 424*b* to the pre-charged firing cell 150*c* and all of the pre-charged firing cells 150 in the same column or data line group as pre-charged firing cell 150*c*, including pre-charged firing cells 150 in fire group 402 and in other fire groups in double data rate firing cell circuit 400. The drain-source path of clock latch transistor 418*b* is electrically coupled to the data line 154 and drain-source path of data latch transistor 152 in each of the pre-charged firing cells 150 in the corresponding data line group. Clock latch transistor 418*b* receives data signal ~D2 at 422*b* and provides clocked data signal ~DC2 at 424*b* to the data line group that includes pre-charged firing cell 150*c*.

Data line 422*b* is also electrically coupled to the pre-charged firing cell 150*d* and all of the pre-charged firing cells 150 in the same column or data line group as pre-charged firing cell 150*d*, including pre-charged firing cells 150 in fire group 402 and in other fire groups in double data rate firing cell circuit 400. The data line 422*b* is electrically coupled to data line 154 and the drain-source path of data latch transistor 152 in each of the pre-charged firing cells 150 in the corresponding data line group. The data line group that includes pre-charged firing cell 150*d* receives data signal ~D2 at 422*b*.

The remaining clock latch transistors 418 in clock latch circuit 404 are similarly electrically coupled to pre-charged firing cells 150 in double data rate firing cell circuit 400, up to and including clock latch transistor 418*n* that includes a drain-source path electrically coupled at one end to data line 422*n* to receive data signal ~Dn. The other end of the drain-source path of clock latch transistor 418*n* is electrically coupled at 424*n* to the pre-charged firing cell 150*m*-1 and all of the pre-charged firing cells 150 in the same column or data line group as pre-charged firing cell 150*m*-1, including pre-charged firing cells 150 in fire group 402 and in other fire groups in double data rate firing cell circuit 400. The drain-source path of clock latch transistor 418*n* is electrically coupled to the data line 154 and drain-source path of data latch transistor 152 in each of the pre-charged firing cells 150 in the corresponding data line group. Clock latch transistor 418*n* receives data signal ~Dn at 422*n* and provides clocked data signal ~DCn at 424*n* to the data line group that includes pre-charged firing cell 150*m*-1.

Data line 422*n* is also electrically coupled to the pre-charged firing cell 150*m* and all of the pre-charged firing cells 150 in the same column or data line group as pre-charged firing cell 150*m*, including pre-charged firing cells 150 in fire group 402 and in other fire groups in double data rate firing cell circuit 400. The data line 422*n* is electrically coupled to data line 154 and the drain-source path of data latch transistor 152 in each of the pre-charged firing cells 150 in the corresponding data line group. The data line group that includes pre-charged firing cell 150*m* receives data signal ~Dn at 422*n*.

Each of the data lines 422*a*-422*n* charges up latched data line nodes via data latch transistors 152 in pre-charged firing cells 150 that are in the fire group that is receiving a high voltage level pre-charge signal. Also, each of the data lines 422*a*-422*n* charges up clocked data lines 424*a*-424*n* at each high voltage pulse in data clock signal CLK and the attached latched data line nodes via data latch transistors 152 in pre-charged firing cells 150 that are in the fire group that is receiving a high voltage level pre-charge signal. The data nodes being charged via data lines 422*a*-422*n* have somewhat higher capacitances than the gate capacitances of non-double data rate firing cell circuits.

In this embodiment, substantially half of the pre-charged firing cells 150 are coupled to receive clocked data signals ~DC1-~DCn and substantially half of the pre-charged firing cells 150 are coupled to receive data signals ~D1-~Dn. Also, every other pre-charged firing cell 150 in a row subgroup is electrically coupled to receive clocked data signals ~DC1-~DCn and the others are coupled to receive data signals ~D1-~Dn. In other embodiments, any suitable percentage of the pre-charged firing-cells 150 can be coupled to receive clocked data signals ~DC1-~DCn and any suitable percentage can be coupled to receive data signals ~D1-~Dn. In other embodiments, the pre-charged firing cells 150 can be coupled to receive clocked data signals ~DC1-~DCn and data signals ~D1-~Dn in any suitable sequence or pattern or no sequence at all.

Each of the data signals ~D1-~Dn includes a first data bit during the first half of the high voltage pulse in pre-charge signal PRECHARGE and a second data bit during the second, half of the high voltage pulse. Also, clock signal DCLK includes a high voltage pulse during the first half of the high voltage pulse in pre-charge signal PRECHARGE.

In operation, pre-charge signal PRECHARGE and clock signal DCLK transition to high voltage levels and each of the data signals ~D1-~Dn includes a first data bit that is provided to the corresponding clock latch transistor 418*a*-418*n* during the high voltage pulse in clock signal DCLK. The clock latch transistors 418*a*-418*n* pass the first data bits to the corresponding data line group of pre-charged firing cells 150*a*, 150*c*, and so on up to 150*m*-1. As the high voltage pulse in clock signal DCLK transitions to a low voltage level, the clock latch transistors 418*a*-418*n* latch the first data bits in to provide clocked data signals ~DC1-~DCn. The first data bits are also provided to the corresponding data line group of pre-charged firing cells 150*b*, 150*d*, and so on up to 150*m*.

Next, each of the data signals ~D1-~Dn includes a second data bit that is provided to the corresponding clock latch transistor 418*a*-418*n* and the corresponding data line group of pre-charged firing cells 150*b*, 150*d*, and so on up to 150*m*, during the second half of the high voltage pulse in pre-charge signal PRECHARGE. The clock latch transistors 418*a*-418*n* are turned off via the low voltage level of clock signal CLK, which prevents the second data bits from passing to the corresponding data line group of pre-charged firing cells 150*a*, 150*c*, and so on up to 150*m*-1.

The clocked data signals ~DC1-~DCn and the second data bits in data signals ~D1-~Dn are received by all pre-charged firing cells 150 in the corresponding data line groups in double data rate firing cell circuit 400. In fire group 402, the clocked data signals ~DC1-~DCn and the second data bits in data signals ~D1-~Dn are received by data lines 154 in the pre-charged firing cells 150 and passed to latched data lines 156 and latched data storage node capacitances 158 via data latch transistors 152 and the high level voltage pulse in the pre-charge signal PRECHARGE. Also, in fire group 402, the storage node capacitances 126 are pre-charged through pre-charge transistors 128 via the high level voltage pulse in the pre-charge signal PRECHARGE. Next, in fire group 402, the data latch transistors 152 are turned off to latch in the clocked data signals ~DC1-~DCn and the second data bits in data signals ~D1-~Dn to provide latched data signals ~LDATAIN as the pre-charge signal PRECHARGE transitions to a low level voltage.

In one embodiment of the pre-charged firing cells 150, after the high level voltage pulse in the pre-charge signal PRECHARGE transitions to a low voltage level, address signals ~ADDRESS1 and ~ADDRESS2 are provided to select row subgroup 406 and a high level voltage pulse is provided in select signal SELECT to turn on select transistors 130. In row subgroup 406, the storage node capacitances 126 either discharge if latched data signal ~LDATAIN is high or remain charged if the latched data signal ~LDATAIN is low. In the row subgroups that are not addressed, the storage node capacitances 126 discharge regardless of the voltage level of latched data signal ~LDATAIN. An energy pulse is provided in fire signal FIRE to energize firing resistors 52 coupled to conducting drive switches 172 in row subgroup 406.

In one embodiment, energizing pre-charged firing cells 150 in double data rate firing cell circuit 400 continues via clocking in first data bits and pre-charging firing cells 150 in another fire group. The clocked data signals and second data bits are latched into the pre-charged firing cells 150 via the falling edge of the pre-charge signal and address signals are provided to select a row subgroup. A high voltage level pulse in a select signal and an energy pulse in a fire signal are provided to energize conducting pre-charged firing cells 150 in the other fire group. This process continues until ejecting fluid is completed.

In other embodiments, the firing cell circuit can include any suitable number of clock latch circuits, such as clock latch circuit 404, to latch in any suitable number of data bits, such as 3 or 4 or more data bits, at each high voltage pulse in the pre-charge signal PRECHARGE. For example, the firing cell circuit can include a second clock latch circuit that clocks in a third data bit via a second data clock and the firing cell circuit latches in the first, second and third data bits as pre-charge signal PRECHARGE transitions from the high voltage level to the low voltage level, such that the firing cell circuit is a triple data rate firing cell circuit.

Figure 11:
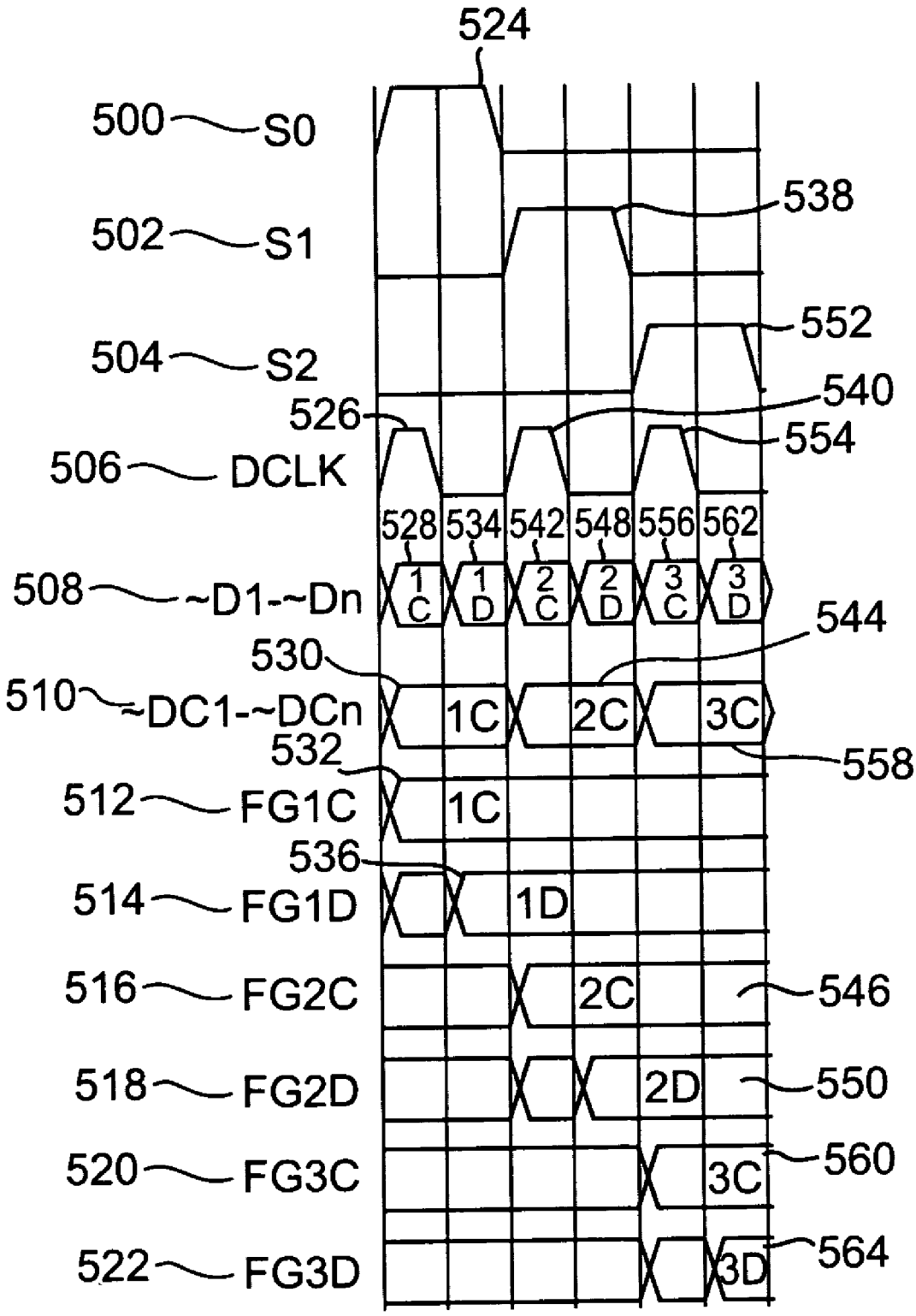
FIG. 11 is a timing diagram illustrating the operation of one embodiment of a double data rate firing cell circuit.

FIG. 11 is a timing diagram illustrating the operation of one embodiment of the double data rate firing cell circuit 400 of FIG. 10. The double data rate firing cell circuit 400 includes a first fire group FG1, a second fire group FG2, a third fire group FG3 and other fire groups, up to fire group FGn. The double data rate firing cell circuit 400 receives pre-charge/select signals S0, S1, S2 and other pre-charge/select signals, up to Sn. The pre-charge/select signals S0-Sn are used as pre-charge signals and/or select signals in the double data rate firing cell circuit 400.

The first fire group FG1 receives signal S0 at 500 as a pre-charge signal and signal S1 at 502 as a select signal. The second fire group FG2 receives signal S1 at 502 as a pre-charge signal and signal S2 at 504 as a select signal. The third fire group FG3 receives signal S2 at 504 as a pre-charge signal and signal S3 (not shown) as a select signal and so on, up to fire group FGn that receives signal Sn-1 (not shown) as a pre-charge signal and signal Sn (not shown) as a select signal.

The clock latch circuit 404 receives data clock signal DCLK at 506 and data signals ~D1-~Dn at 508 and provides clocked data signals ~DC1-~DCn at 510. The fire groups FG1-FGn latch in the data signals ~D1-~Dn at 508 and clocked data signals ~DC1-~DCn at 510 to provide latched in clocked data signals and latched in data signals, which are used to turn on drive switches 172 to energize selected firing resistors 52. Each of the fire groups receives a fire signal that includes energy pulses to energize the selected firing resistors 52. In one embodiment, an energy pulse starts substantially toward the middle or end of the high voltage pulse in the select signal of the fire group to energize selected firing resistors 52 in the fire group.

The first fire group FG1 latches in data signals ~D1-~Dn at 508 and clocked data signals ~DC1-~DCn at 510 to provide latched first fire group clocked data signals FG1C at 512 and latched first fire group data signals FG1D at 514. The second fire group FG2 latches in data signals ~D1-~Dn at 508 and clocked data signals ~DC1-~DCn at 510 to provide latched second fire group clocked data signals FG2C at 516 and latched second fire group data signals FG2D at 518. The third fire group FG3 latches in data signals ~D1-~Dn at 508 and clocked data signals ~DC1-~DCn at 510 to provide latched third fire group clocked data signals FG3C at 520 and latched third fire group data signals FG3D at 522. The other fire groups also latch in data signals ~D1-~Dn at 508 and clocked data signals ~DC1-~DCn at 510 to provide latched clocked data signals and latched data signals similar to fire groups FG1-FG3.

To begin, signal S0 at 500 provides a high voltage pulse at 524 in the pre-charge signal of the first fire group FG1 and data clock signal DCLK at 506 provides a high voltage pulse at 526 during the first half of the high voltage pulse at 524. Clock latch circuit 404 receives the high voltage pulse at 526 and passes data signals ~D1-~Dn at 508 to provide clocked data signals ~DC1-~DCn at 510.

During the first half of the high voltage pulse at 524, data signals ~D1-~Dn at 508 include the first fire group clocked data signals 1C at 528 that are passed through clock latch circuit 404 to provide the first fire group clocked data signals 1C at 530 in clocked data signals ~DC1-~DCn at 510. Also, the first fire group clocked data signals 1C at 530 are passed through data latch transistors 152 in pre-charged firing cells 150 of the first fire group FG1 to provide the first fire group clocked data signals 1C at 532 in latched first fire group clocked data signals FG1C at 512. The first fire group clocked data signals 1C at 530 are latched in as clocked data signals ~DC1-~DCn at 510 as the high voltage pulse 526 transitions to a low logic level. The first fire group clocked data signals 1C at 528 must be held until after the high voltage pulse 526 transitions below transistor threshold values.

During the second half of the high voltage pulse at 524, data signals ~D1-~Dn at 508 include first fire group data signals 1D at 534. The first fire group data signals 1D at 534 are passed through data latch transistors 152 in pre-charged firing cells 150 of the first fire group FG1 that are attached to data lines 422 to provide the first fire group data signals 1D at 536 in latched first fire group data signals FG1D at 514. The first fire group clocked data signals 1C at 532 and the first fire group data signals 1D at 536 are latched into pre-charged firing cells 150 in the first fire group FG1 as the high voltage pulse 524 transitions to a low logic level. The first fire group data signals 1D at 534 must be held until after the high voltage pulse 524 transitions below transistor threshold values.

Address signals are provided to select a row subgroup and signal S1 at 502 provides a high voltage pulse at 538 in the select signal of the first fire group FG1 and the pre-charge signal of the second fire group FG2. The high voltage pulse at 538 turns on select transistors 130 in the pre-charged firing cells 150 of first fire group FG1. In the addressed row subgroup, the storage node capacitances 126 either discharge if the latched first fire group data FG1C at 512 and FG1D at 514 is high or remain charged if the latched first fire group data FG1C at 512 and FG1D at 514 is low. In the row subgroups that are not addressed, the storage node capacitances 126 discharge regardless of the voltage level of latched first fire group data FG1C at 512 and FG1D at 514. An energy pulse is provided in the first fire group fire signal to energize firing resistors 52 coupled to conducting drive switches 172 in the addressed row subgroup.

Data clock signal DCLK at 506 provides a high voltage pulse at 540 during the first half of the high voltage pulse at 538. Clock latch circuit 404 receives the high voltage pulse at 540 and passes the data signals ~D1-~Dn at 508 to provide the clocked data signals ~DC1-~DCn at 510.

During the first half of the high voltage pulse at 538, data signals ~D1-~Dn at 508 include the second fire group clocked data signals 2C at 542 that are passed through clock latch circuit 404 to provide the second fire group clocked data signals 2C at 544 in clocked data signals ~DC1-~DCn at 510. Also, the second fire group clocked data signals 2C at 544 are passed through data latch transistors 152 in pre-charged firing cells 150 of the second fire group FG2 to provide the second fire group clocked data signals 2C at 546 in latched second fire group clocked data signals FG2C at 516. The second fire group clocked data signals 2C at 544 are latched in as clocked data signals ~DC1-~DCn at 510 as the high voltage pulse 540 transitions to a low logic level. The second fire group clocked data signals 2C at 542 must be held until after the high voltage pulse 540 transitions below transistor threshold values.

During the second half of the high voltage pulse at 538, data signals ~D1-~Dn at 508 include the second fire group data signals 2D at 548. The second fire group data signals 2D at 548 are passed through data latch transistors 152 in pre-charged firing cells 150 of the second fire group FG2 that are attached to data lines 422 to provide the second fire group data signals 2D at 550 in latched second fire group data signals FG2D at 518. The second fire group clocked data signals 2C at 546 and the second fire group data signals 2D at 550 are latched into pre-charged firing cells 150 in the second fire group FG2 as the high voltage pulse 538 transitions to a low logic level. The second fire group data signals 2D at 548 must be held until after the high voltage pulse 538 transitions below transistor threshold values.

Address signals are provided to select a row subgroup and signal S2 at 504 provides a high voltage pulse at 552 in the select signal of the second fire group FG2 and the pre-charge signal of the third fire group FG3. The high voltage pulse at 552 turns on select transistors 130 in the pre-charged firing cells 150 of second fire group FG2. In the addressed row subgroup, the storage node capacitances 126 either discharge if the latched second fire group data FG2C at 516 and FG2D at 518 is high or remain charged if the latched second fire group data FG2C at 516 and FG2D at 518 is low. In the row subgroups that are not addressed, the storage node capacitances 126 discharge regardless of the voltage level of latched second fire group data FG2C at 516 and FG2D at 518. An energy pulse is provided in the second fire group fire signal to energize firing resistors 52 coupled to conducting drive switches 172 in the addressed row subgroup.

Data clock signal DCLK at 506 provides a high voltage pulse at 554 during the first half of the high voltage pulse at 552. Clock latch circuit 404 receives the high voltage pulse at 554 and passes the data signals ~D1-~Dn at 508 to provide the clocked data signals ~DC1-~DCn at 510.

During the first half of the high voltage pulse at 552, data signals ~D1-~Dn at 508 include the third fire group clocked data signals 3C at 556 that are passed through clock latch circuit 404 to provide the third fire group clocked data signals 3C at 558 in clocked data signals ~DC1-~DCn at 510. Also, the third fire group clocked data signals 3C at 558 are passed through data latch transistors 152 in pre-charged firing cells 150 of the third fire group FG3 to provide the third fire group clocked data signals 3C at 560 in latched third fire group clocked data signals FG3C at 520. The third fire group clocked data signals 3C at 558 are latched in as clocked data signals ~DC1-~DCn at 510 as the high voltage pulse 554 transitions to a low logic level. The third fire group clocked data signals 3C at 556 must be held until after the high voltage pulse 554 transitions below transistor threshold values.

During the second half of the high voltage pulse at 552, data signals ~D1-~Dn at 508 include third fire group data signals 3D at 562. The third fire group data signals 3D at 562 are passed through data latch transistors 152 in pre-charged firing cells 150 of the third fire group FG3 that are attached to data lines 422 to provide the third fire group data signals 3D at 564 in latched third fire group data signals FG3D at 522. The third fire group clocked data signals 3C at 560 and the third fire group data signals 3D at 564 are latched into pre-charged firing cells 150 in the third fire group FG3 as the high voltage pulse 552 transitions to a low logic level. The third fire group data signals 3D at 562 must be held until after the high voltage pulse 552 transitions below transistor threshold values.

This process continues up to and including fire group FGn that receives signal Sn-1 as a pre-charge signal and signal Sn as a select signal. The process then repeats itself beginning with the first fire group FG1 until ejecting fluid is completed.

Figure 12:
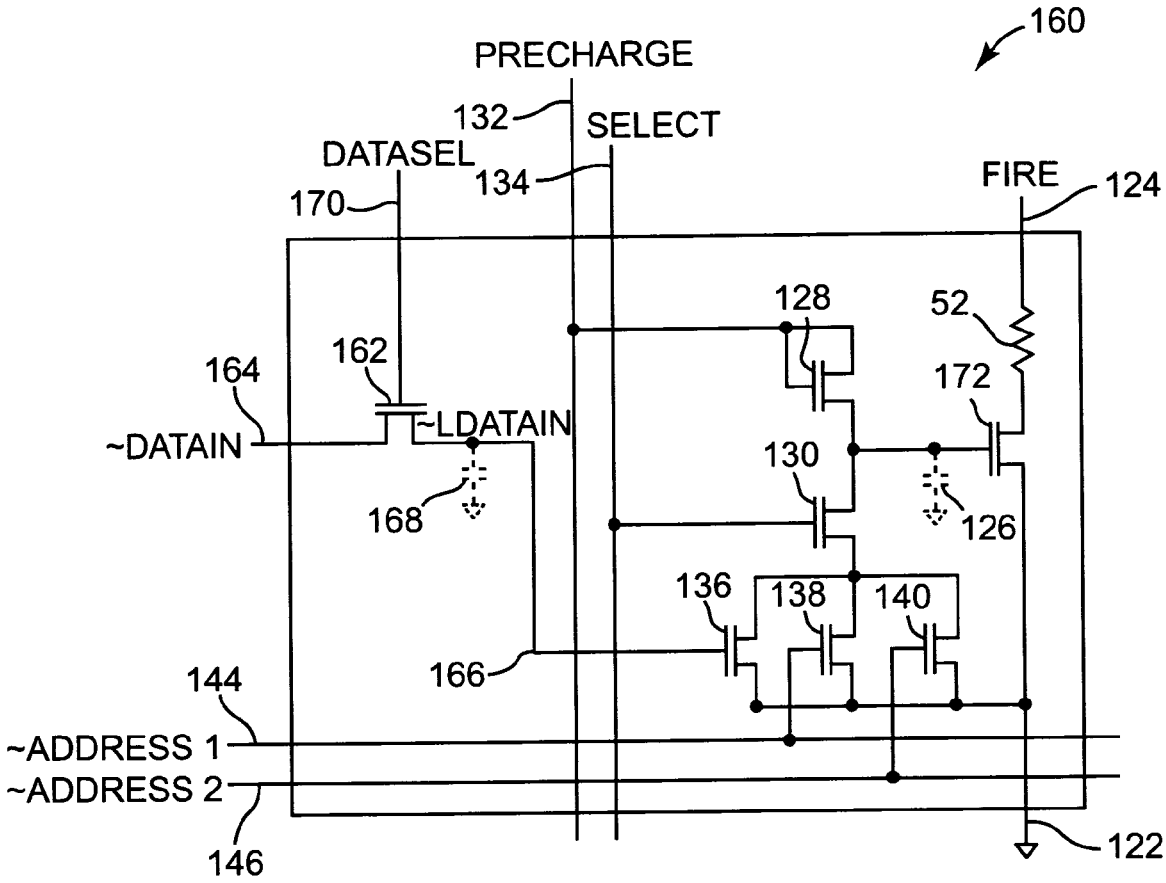
FIG. 12 is a schematic diagram illustrating one embodiment of a pre-charged firing cell.

FIG. 12 is a schematic diagram illustrating one embodiment of a pre-charged firing cell 160 that can be used in multiple data rate firing cell circuits. The pre-charged firing cell 160 is similar to the pre-charged firing cell 120 of FIG. 6 and includes drive switch 172, firing resistor 52 and the memory cell of pre-charged firing cell 120. Elements of pre-charged firing cell 160 that coincide with elements of pre-charged firing cell 120 have the same numbers as the elements of pre-charged firing cell 120 and are electrically coupled together and to signal lines as described in the description of FIG. 6, with the exception that the gate of data transistor 136 is electrically coupled to latched data line 166 that receives latched data signal ~LDATAIN instead of being coupled to data line 142 that receives data signal ~DATA. In addition, elements of pre-charged firing cell 160 that coincide with elements in pre-charged firing cell 120 function and operate as described in the description of FIG. 6.

Pre-charged firing cell 160 includes a data latch transistor 162 that includes a drain-source path electrically coupled between data line 164 and latched data line 166. Data line 164 receives data signals ~DATAIN and data latch transistor 162 latches data into pre-charged firing cell 160 to provide latched data signals ~LDATAIN. Data signals ~DATAIN and latched data signals ~LDATAIN are active when low as indicated by the tilde (~) at the beginning of the signal name. The gate of data latch transistor 162 is electrically coupled to data select line 170 that receives a data select signal DATASEL.

In one embodiment, the data latch transistor 162 is a minimum sized transistor to minimize charge sharing between the latched data line 166 and the gate to source node of data latch transistor 162 as the data select signal transitions from a high voltage level to a low voltage level. This charge sharing reduces high voltage level latched data. Also, in one embodiment, the drain of the data latch transistor 162 determines the capacitance seen at data line 164 when the data select signal is at a low voltage level and a minimum sized transistor keeps this capacitance low.

Data latch transistor 162 passes data from data line 164 to latched data line 166 and a latched data storage node capacitance 168 via a high level data select signal. The data is latched onto the latched data line 164 and the latched data storage node capacitance 168 as the data select signal transitions from a high voltage level to a low voltage level. The latched data storage node capacitance 168 is shown in dashed lines, as it is part of data transistor 136. Alternatively, a capacitor separate from data transistor 136 can be used to store latched data.

The latched data storage node capacitance 168 is large enough to remain at substantially a high level as the data select signal transitions from a high level to a low level. Also, the latched data storage node capacitance 168 is large enough to remain at substantially a low level as an energy pulse is provided via the fire signal FIRE and a high voltage pulse is provided in select signal SELECT and a high voltage pulse is provided in pre-charge signal PRECHARGE. In addition, data transistor 136 is small enough to maintain a low level on the latched data storage node capacitance 168 as the gate of drive switch 172 is discharged and large enough to fully discharge the gate of drive switch 172 before the beginning of an energy pulse in the fire signal FIRE.

In one embodiment of a double data rate firing cell circuit using pre-charged firing cells 160, each of the data select lines 170 is electrically coupled to a pre-charge line, a first clock or a second clock. In some fire groups, the first clock is electrically coupled to data select lines 170 in some pre-charged firing cells 160 and the fire group pre-charge line is electrically coupled to data select lines 170 in the other pre-charged firing cells 160. In other fire groups, the second clock is electrically coupled to data select lines 170 in some pre-charged firing cells 160 and the fire group pre-charge line is electrically coupled to data select lines 170 in the other pre-charged firing cells 160. The first clock includes a high voltage pulse in the first half of each high voltage pulse in pre-charge signals of fire groups coupled to the first clock. The second clock includes a high voltage pulse in the first half of each high voltage pulse in pre-charge signals of fire groups coupled to the second clock. Thus, in some fire groups the first clock and pre-charge signal latch in two data bits during each high voltage pulse in the pre-charge signal and in other fire groups the second clock and pre-charge signal latch in two data bits during each high voltage pulse in the pre-charge signal. In other embodiments of multiple data rate firing cell circuits that use pre-charge firing cells 160, any suitable number of clock signals can be used to latch in multiple data bits, such as three or more data bits, during the high voltage pulse of a pre-charge signal.

In a multiple data rate firing cell circuit that uses pre-charged firing cells 160, some data lines charge up latched data line nodes in one fire group at a time, where each fire group receives the high voltage level in the pre-charge signal of the fire group. Other data lines charge up latched data line nodes in a number of fire groups, where a number of fire groups receive the high voltage pulse in a clock signal.

In operation of pre-charged firing cell 160, data signal ~DATAIN is received by data line 164 and passed to latched data line 166 and latched data storage node capacitance 168 via data latch transistor 162 by providing a high voltage pulse on data select line 170. Storage node capacitance 126 is pre-charged through pre-charge transistor 128 via a high voltage pulse on pre-charge line 132. Data latch transistor 162 is turned off to provide latched data signals ~LDATAIN as the voltage pulse on data select line 170 transitions from the high voltage level to a low level voltage. The data to be latched into pre-charged firing cell 160 is provided while the data select signal is at a high voltage level and held until after the data select signal transitions to a low voltage level. The high voltage pulse in the data select signal occurs either during the high voltage pulse in the pre-charge signal or it is the high voltage pulse in the pre-charge signal. In contrast, the data to be latched into pre-charged firing cell 120 of FIG. 6 is provided while the select signal is at a high voltage level.

In one embodiment of pre-charge firing cell 160, after the high level voltage pulse on data select line 170, address signals ~ADDRESS1 and ~ADDRESS2 are provided on address lines 144 and 146 to set the states of first address transistor 138 and second address transistor 140. A high level voltage pulse is provided on select line 134 to turn on select transistor 130 and storage node capacitance 126 discharges if data transistor 136, first address transistor 138 and/or second address transistor 140 is on. Alternatively, storage node capacitance 126 remains charged if data transistor 136, first address transistor 138 and second address transistor 140 are all off.

Pre-charged firing cell 160 is an addressed firing cell if both address signals ~ADDRESS1 and ~ADDRESS2 are low, and storage node capacitance 126 either discharges if latched data signal ~LDATAIN is high or remains charged if latched data signal ~LDATAIN is low. Pre-charged firing cell 160 is not an addressed firing cell if at least one of the address signals ~ADDRESS1 and ~ADDRESS2 is high, and storage node capacitance 126 discharges regardless of the voltage level of latched data signal ~LDATAIN. The first and second address transistors 136 and 138 comprise an address decoder and, if pre-charged firing cell 160 is addressed, data transistor 136 controls the voltage level on storage node capacitance 126.

Figure 13:
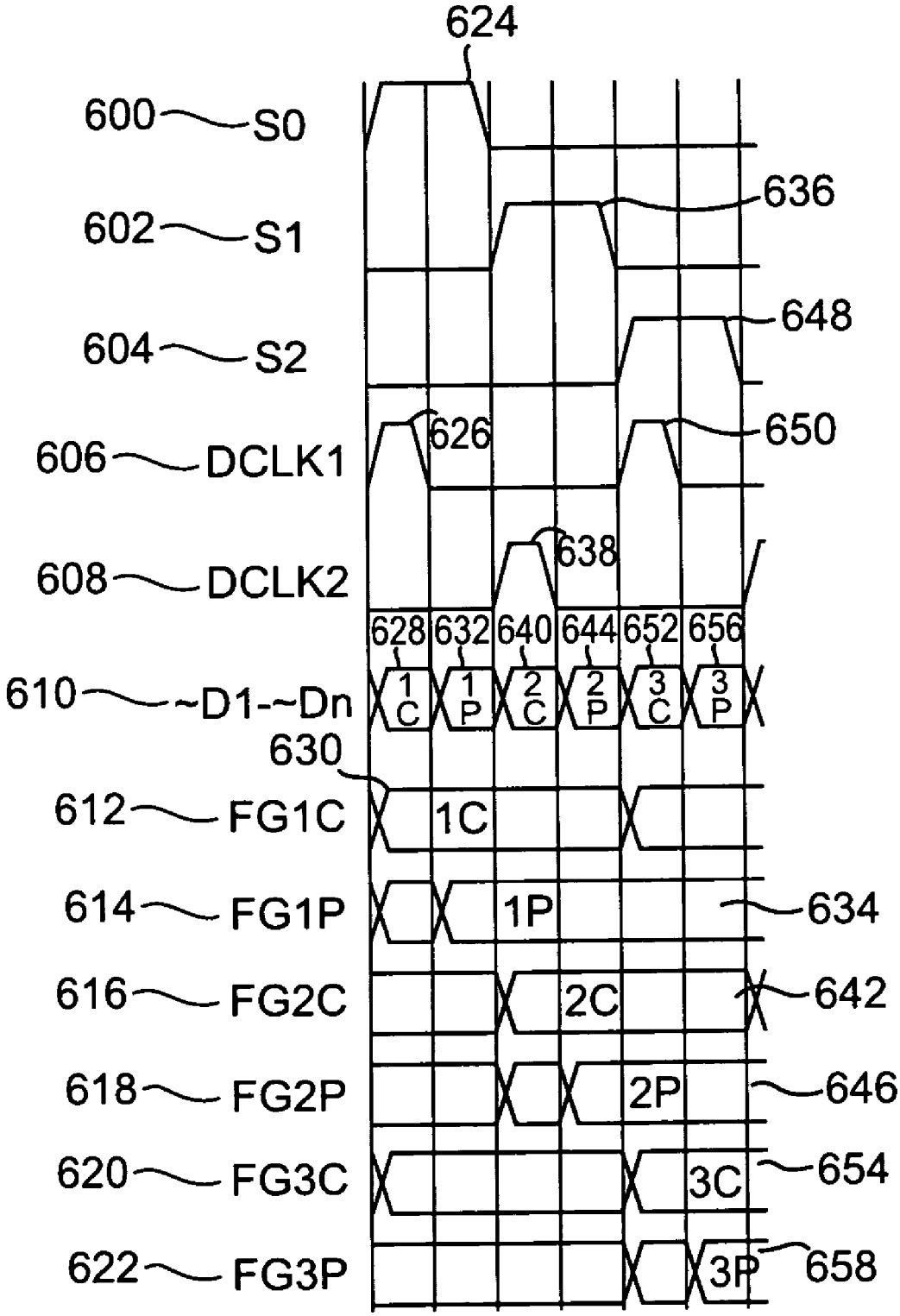
FIG. 13 is a timing diagram illustrating the operation of one embodiment of a double data rate firing cell circuit using the pre-charged firing cell of FIG. 12.

FIG. 13 is a timing diagram illustrating the operation of one embodiment of a double data rate firing cell circuit using pre-charged firing cells 160. Each of the data select lines 170 is electrically coupled to a pre-charge line, a first data clock or a second data clock. The double data rate firing cell circuit includes a first fire group FG1, a second fire group FG2, a third fire group FG3 and other fire groups, up to fire group FGn. The double data rate firing cell circuit receives pre-charge/select signals S0, S1, S2 and other pre-charge/select signals, up to Sn. The pre-charge/select signals S0-Sn are used as pre-charge signals and/or select signals in the double data rate firing cell circuit.

The first fire group FG1 receives signal S0 at 600 as a pre-charge signal and signal S1 at 602 as a select signal. The second fire group FG2 receives signal S1 at 602 as a pre-charge signal and signal S2 at 604 as a select signal. The third fire group FG3 receives signal S2 at 604 as a pre-charge signal and signal S3 (not shown) as a select signal and so on, up to fire group FGn that receives signal Sn-1 (not shown) as a pre-charge signal and signal Sn (not shown) as a select signal.

The double data rate firing cell circuit receives a first data clock signal DCLK1 at 606 via the first data clock and a second data clock signal DCLK2 at 608 via the second data clock. The first data clock is electrically coupled to the data select lines 170 of substantially half of the pre-charged firing cells 160 in odd numbered fire groups, such as first fire group FG1 and third fire group FG3. The pre-charge line of each fire group is electrically coupled to the data select lines 170 of substantially the other half of the pre-charged firing cells 160 in the odd numbered fire groups. The second data clock is electrically coupled to the data select lines 170 of substantially half of the pre-charged firing cells 160 in even numbered fire groups, such as second fire group FG2 and fourth fire group FG4, and the pre-charge line of each fire group is electrically coupled to the data select lines 170 of substantially the other half of the pre-charged firing cells 160 in the even numbered fire groups.

The first data clock signal DCLK1 at 606 includes a high voltage pulse in the first half of each high voltage pulse in pre-charge signals of fire groups coupled to the first data clock and the second data clock signal DCLK2 at 608 includes a high voltage pulse in the first half of each high voltage pulse in pre-charge signals of fire groups coupled to the second data clock. Data lines provide data signals ~D1-~Dn at 610, wherein each of the data lines provides one of the data signals ~D1-~Dn at 610 and a first data bit during the first half of the high voltage pulse in a pre-charge signal and a second data bit during the second half of the high voltage pulse in the pre-charge signal. Each data line is electrically coupled to pre-charged firing cells 160 in all fire groups. Also, each data line is electrically coupled to pre-charged firing cells 160 in a fire group that have data select lines 170 coupled to the first or second data clock and to pre-charged firing cells 160 in the fire group that have data select lines 170 coupled to the pre-charge line of the fire group.

In odd numbered fire groups the first data clock signal DCLK1 at 606 and a pre-charge signal latch in two data bits during each high voltage pulse in the pre-charge signal. In even numbered fire groups the second data clock signal DCLK2 at 608 and a pre-charge signal latch in two data bits during each high voltage pulse in the pre-charge signal. In other embodiments of multiple data rate firing cell circuits that use pre-charge firing cells 160, any suitable number of data clock signals can be used to latch in multiple data bits, such as three or more data bits, during the high voltage pulse of a pre-charge signal.

The fire groups FG1-FGn latch in the data signals ~D1-~Dn at 610 to provide latched in clocked data signals and latched in pre-charge data signals, which are used to turn on drive switches 172 to energize selected firing resistors 52. Each of the fire groups receives a fire signal that includes energy pulses to energize the selected firing resistors 52. In one embodiment, an energy pulse starts substantially toward the middle or end of the high voltage pulse in the select signal of the fire group to energize selected firing resistors 52 in the fire group.

The first fire group FG1 latches in data signals ~D1-~Dn at 610 to provide latched first fire group clocked data signals FG1C at 612 and latched first fire group pre-charge data signals FG1P at 614. The second fire group FG2 latches in data signals ~D1-~Dn at 610 to provide latched second fire group clocked data signals FG2C at 616 and latched second fire group pre-charge data signals FG2P at 618. The third fire group FG3 latches in data signals ~D1-~Dn at 610 to provide latched third fire group clocked data signals FG3C at 620 and latched third fire group pre-charge data signals FG3P at 622. The other fire groups also latch in data signals ~D1-~Dn at 610 to provide latched clocked data signals and latched pre-charge data signals similar to fire groups FG1-FG3.

To begin, signal S0 at 600 provides a high voltage pulse at 624 in the pre-charge signal of the first fire group FG1. During the first half of the high voltage pulse at 624, first data clock signal DCLK1 at 606 provides a high voltage pulse at 626. Data signals ~D1-~Dn at 610 include the first fire group clocked data signals 1C at 628, which are passed through data latch transistors 162 coupled to the first data clock in the first fire group FG1 to provide the first fire group clocked data signals 1C at 630 in latched first fire group clocked data signals FG1C at 612. The first fire group clocked data signals 1C at 630 are latched in as the high voltage pulse 626 transitions to a low logic level. The first fire group clocked data signals 1C at 628 must be held until after the high voltage pulse 626 transitions below transistor threshold values.

During the second half of the high voltage pulse at 624, data signals ~D1-~Dn at 610 include first fire group pre-charge data signals 1P at 632. The first fire group pre-charge data signals 1P at 632 are passed through data latch transistors 162 that are coupled to the pre-charge line of the first fire group FG1 to provide the first fire group pre-charge data signals 1P at 634 in latched first fire group pre-charge data signals FG1P at 614. The first fire group pre-charge data signals 1P at 634 are latched into pre-charged firing cells 160 in the first fire group FG1 as the high voltage pulse 624 transitions to a low logic level. The first fire group pre-charge data signals 1P at 632 must be held until after the high voltage pulse 624 transitions below transistor threshold values.

Address signals are provided to select a row subgroup and signal S1 at 602 provides a high voltage pulse at 636 in the select signal of the first fire group FG1 and the pre-charge signal of the second fire group FG2. The high voltage pulse at 636 turns on select transistors 130 in the pre-charged firing cells 160 of first fire group FG1. In the addressed row subgroup, the storage node capacitances 126 either discharge if the latched first fire group data FG1C at 612 and FG1P at 614 is high or remain charged if the latched first fire group data FG1C at 612 and FG1P at 614 is low. In the row subgroups that are not addressed, the storage node capacitances 126 discharge regardless of the voltage level of latched first fire group data FG1C at 612 and FG1P at 614. An energy pulse is provided in the first fire group fire signal to energize firing resistors 52 coupled to conducting drive switches 172 in the addressed row subgroup.

During the first half of the high voltage pulse at 636, second data clock signal DCLK2 at 608 provides a high voltage pulse at 638. Data signals ~D1-~Dn at 610 include the second fire group clocked data signals 2C at 640, which are passed through data latch transistors 162 coupled to the second data clock in the second fire group FG2 to provide the second fire group clocked data signals 2C at 642 in latched second fire group clocked data signals FG2C at 616. The second fire group clocked data signals 2C at 642 are latched in as the high voltage pulse 638 transitions to a low logic level. The second fire group clocked data signals 2C at 640 must be held until after the high voltage pulse 638 transitions below transistor threshold values.

During the second half of the high voltage pulse at 636, data signals ~D1-~Dn at 610 include second fire group pre-charge data signals 2P at 644. The second fire group pre-charge data signals 2P at 644 are passed through data latch transistors 162 that are coupled to the pre-charge line of the second fire group FG2 to provide the second fire group pre-charge data signals 2P at 646 in latched second fire group pre-charge data signals FG2P at 618. The second fire group pre-charge data signals 2P at 646 are latched into pre-charged firing cells 160 in the second fire group FG2 as the high voltage pulse 636 transitions to a low logic level. The second fire group pre-charge data signals 2P at 644 must be held until after the high voltage pulse 636 transitions below transistor threshold values.

Address signals are provided to select a row subgroup and signal S2 at 604 provides a high voltage pulse at 648 in the select signal of the second fire group FG2 and the pre-charge signal of the third fire group FG3. The high voltage pulse at 648 turns on select transistors 130 in the pre-charged firing cells 160 of second fire group FG2. In the addressed row subgroup, the storage node capacitances 126 either discharge if the latched second fire group data FG2C at 616 and FG2P at 618 is high or remain charged if the latched second fire group data FG2C at 616 and FG2P at 618 is low. In the row subgroups that are not addressed, the storage node capacitances 126 discharge regardless of the voltage level of latched second fire group data FG2C at 616 and FG2P at 618. An energy pulse is provided in the second fire group fire signal to energize firing resistors 52 coupled to conducting drive switches 172 in the addressed row subgroup.

During the first half of the high voltage pulse at 648, first data clock signal DCLK1 at 606 provides a high voltage pulse at 650. Data signals ~D1-~Dn at 610 include the third fire group clocked data signals 3C at 652, which are passed through data latch transistors 162 coupled to the first data clock in the third fire group FG3 to provide the third fire group clocked data signals 3C at 654 in latched third fire group clocked data signals FG3C at 620. The third fire group clocked data signals 3C at 654 are latched in as the high voltage pulse 650 transitions to a low logic level. The third fire group clocked data signals 3C at 652 must be held until after the high voltage pulse 650 transitions below transistor threshold values.

During the second half of the high voltage pulse at 648, data signals ~D1-~Dn at 610 include third fire group pre-charge data signals 3P at 656. The third fire group pre-charge data signals 3P at 656 are passed through data latch transistors 162 that are coupled to the pre-charge line of the third fire group FG3 to provide the third fire group pre-charge data signals 3P at 658 in latched third fire group pre-charge data signals FG3P at 622. The third fire group pre-charge data signals 3P at 658 are latched into pre-charged firing cells 160 in the third fire group FG3 as the high voltage pulse 648 transitions to a low logic level. The third fire group pre-charge data signals 3P at 656 must be held until after the high voltage pulse 648 transitions below transistor threshold values.

This process continues up to and including fire group FGn that receives signal Sn-1 as a pre-charge signal and signal Sn as a select signal. The process then repeats itself beginning with the first fire group FG1 until ejecting fluid is completed.

Figure 14:
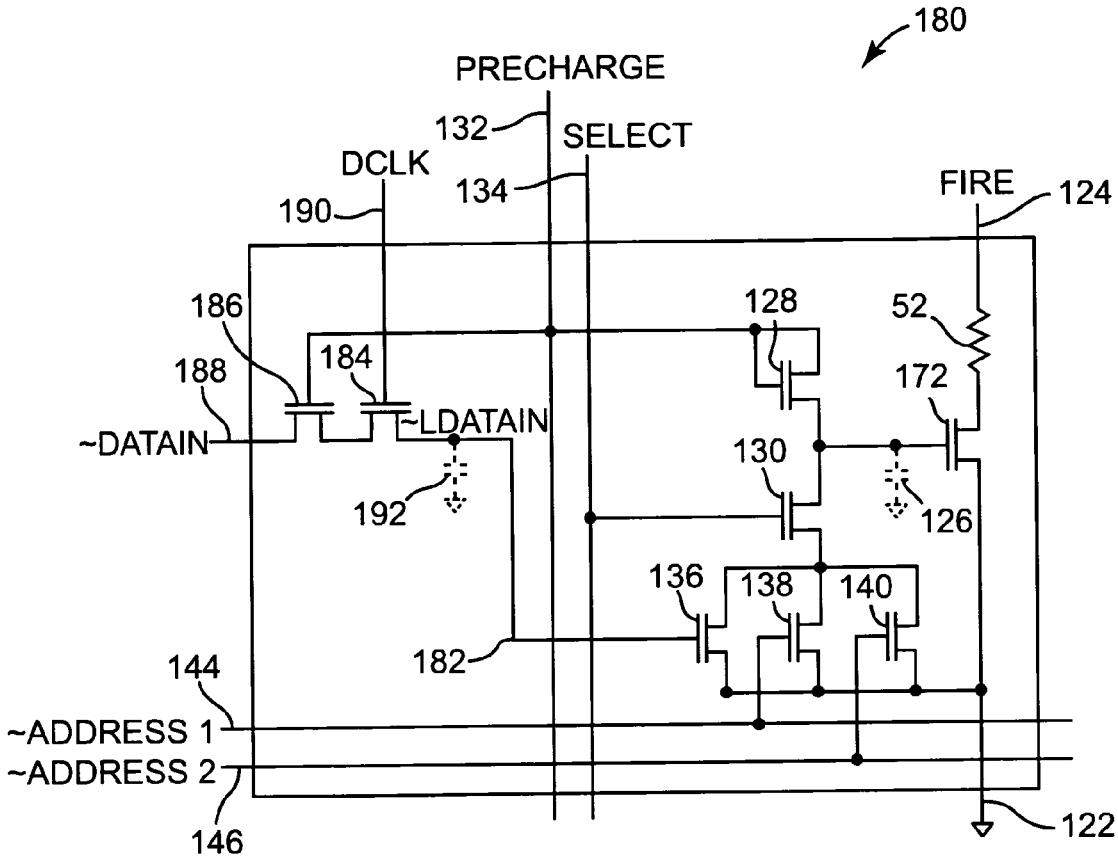
FIG. 14 is a schematic diagram illustrating one embodiment of a two pass transistor pre-charged firing cell.

FIG. 14 is a schematic diagram illustrating one embodiment of a two pass transistor pre-charged firing cell 180. The pre-charged firing cell 180 can be used with the pre-charged firing cell 160 of FIG. 12 in multiple data rate firing cell circuits. In one embodiment of a multiple data rate firing cell circuit that uses only the pre-charged firing cells 160 of FIG. 12, some data lines charge up latched data line nodes coupled to data latch transistors 162 that receive a high voltage pulse in a data clock signal, including latched data nodes in all of the fire groups that receive the data clock signal. In these multiple data rate firing cell circuits, the two pass transistor pre-charged firing cell 180 can be used in place of pre-charged firing cells 160 that receive data clock signals. The two pass transistor pre-charged firing cells 180 reduce data line capacitance, such that data lines charge up latched data line nodes in only the one fire group that is receiving a high voltage pulse in the pre-charge signal of the fire group.

The pre-charged firing cell 180 is similar to the pre-charged firing cell 120 of FIG. 6 and includes drive switch 172, firing resistor 52 and the memory cell of pre-charged firing cell 120. Elements of pre-charged firing cell 180 that coincide with elements of pre-charged firing cell 120 have the same numbers as the elements of pre-charged firing cell 120 and are electrically coupled together and to signal lines as described in the description of FIG. 6, with the exception that the gate of data transistor 136 is electrically coupled to latched data line 182 that receives latched data signal ~LDATAIN instead of being coupled to data line 142 that receives data signal ~DATA. In addition, elements of pre-charged firing cell 180 that coincide with elements in pre-charged firing cell 120 function and operate as described in the description of FIG. 6.

Pre-charged firing cell 180 includes a clocked data latch transistor 184 and a pre-charge pass transistor 186. The clocked data latch transistor 184 includes a drain-source path electrically coupled between the drain-source path of pre-charge pass transistor 186 and latched data line 182. The drain-source path of pre-charge pass transistor 186 is electrically coupled between the drain-source path of clocked data latch transistor 184 and data line 188. The gate of data latch transistor 184 is electrically coupled to data clock line 190 that receives a data clock signal DCLK and the gate of pre-charge pass transistor 186 is electrically coupled to pre-charge line 132 that receives pre-charge signal PRECHARGE. Data clock signal DCLK at 190 includes a high voltage pulse during the high voltage pulse in pre-charge signal PRECHARGE. Data line 188 receives data signals ~DATAIN and clocked data latch transistor 184 latches the data into pre-charged firing cell 180 to provide latched data signals ~LDATAIN. Data signals ~DATAIN and latched data signals ~LDATAIN are active when low as indicated by the tilde (~) at the beginning of the signal name.

Data line 188 receives data signals ~DATAIN and pre-charge pass transistor 186 passes data from data line 188 to clocked latch transistor 184 via a high voltage pulse in the pre-charge signal. Clocked latch transistor 184 passes the data to latched data line 182 and a latched data storage node capacitance 192 via a high voltage pulse in the data clock signal. The high voltage pulse in the data clock signal occurs during the high voltage pulse in the pre-charge signal.

The data is latched onto the latched data line 182 and the latched data storage node capacitance 192 as the data clock signal transitions from a high voltage to a low voltage level. The latched data storage node capacitance 192 is shown in dashed lines, as it is part of data transistor 136. Alternatively, a capacitor separate from data transistor 136 can be used to store latched data.

The latched data storage node capacitance 192 is large enough to remain at substantially a high level as the data clock signal transitions from a high level to a low level. Also, the latched data storage node capacitance 192 is large enough to remain at substantially a low level as an energy pulse is provided via the fire signal FIRE and a high voltage pulse is provided in select signal SELECT and a high voltage pulse is provided in pre-charge signal PRECHARGE. In addition, data transistor 136 is small enough to maintain a low level on the latched data storage node capacitance 192 as the gate of drive switch 172 is discharged and large enough to fully discharge the gate of drive switch 172 before the beginning of an energy pulse in the fire signal FIRE.

In one embodiment of a double data rate firing cell circuit using pre-charged firing cells 160 and two pass transistor pre-charged firing cells 180, each fire group includes substantially half pre-charged firing cells 160 and substantially half two pass transistor pre-charged firing cells 180. The data select lines 170 of all pre-charged firing cells 160 in a fire group are electrically coupled to the pre-charge line of that fire group. Also, the pre-charge pass transistors 186 of all pre-charge firing cells 180 in a fire group are electrically coupled to the pre-charge line of that fire group. A first clock is electrically coupled to all data clock lines 190 in pre-charged firing cells 180 in some fire groups and a second clock is electrically coupled to all data clock lines 190 in pre-charged firing cells 180 in other fire groups. The first clock includes a high voltage pulse in the first half of each high voltage pulse in pre-charge signals of fire groups coupled to the first clock. The second clock includes a high voltage pulse in the first half of each high voltage pulse in pre-charge signals of fire groups coupled to the second clock. Thus, in some fire groups the first clock and pre-charge signal latch in two data bits during each high voltage pulse in the pre-charge signal and in other fire groups the second clock and pre-charge signal latch in two data bits during each high voltage pulse in the pre-charge signal. In this multiple data rate firing cell circuit that uses pre-charged firing cells 160 and two pass transistor pre-charged firing cells 160, data lines charge up latched data line nodes in the fire group receiving a high voltage level pre-charge signal.

In operation of pre-charged firing cell 180, data signal ~DATAIN is received by data line 188 and passed to clocked data latch transistor 184 via pre-charge pass transistor 186 by providing a high voltage pulse in the pre-charge signal. Clocked data latch transistor 184 passes the data to latched data line 182 and latched data storage node capacitance 192 via a high voltage pulse in the data clock signal. The high voltage pulse in the data clock signal occurs during the high voltage pulse in the pre-charge signal.

Storage node capacitance 126 is pre-charged through pre-charge transistor 128 via the high voltage pulse in the pre-charge signal. Clocked data latch transistor 184 is turned off to provide latched data signals ~LDATAIN as the high voltage pulse in the data clock signal transitions from a high voltage level to a low level voltage. The data that is latched into pre-charged firing cell 180 is provided while the data clock signal is at a high voltage level and held until after the data clock signal transitions to a low voltage level, which occurs during the high voltage pulse in the pre-charge signal. In contrast, the data to be latched into pre-charged firing cell 120 of FIG. 6 is provided while the select signal is at a high voltage level.

In one embodiment of pre-charge firing cell 180, after the high level voltage pulse in the data clock signal, address signals ~ADDRESS1 and ~ADDRESS2 are provided on address lines 144 and 146 to set the states of first address transistor 138 and second address transistor 140. A high voltage pulse is provided on select line 134 to turn on select transistor 130 and storage node capacitance 126 discharges if data transistor 136, first address transistor 138 and/or second address transistor 140 is on. Alternatively, storage node capacitance 126 remains charged if data transistor 136, first address transistor 138 and second address transistor 140 are all off.

Pre-charged firing cell 180 is an addressed firing cell if both address signals ~ADDRESS1 and ~ADDRESS2 are low, and storage node capacitance 126 either discharges if latched data signal ~LDATAIN is high or remains charged if latched data signal ~LDATAIN is low. Pre-charged firing cell 180 is not an addressed firing cell if at least one of the address signals ~ADDRESS1 and ~ADDRESS2 is high, and storage node capacitance 126 discharges regardless of the voltage level of latched data signal ~LDATAIN. The first and second address transistors 136 and 138 comprise an address decoder and, if pre-charged firing cell 180 is addressed, data transistor 136 controls the voltage level on storage node capacitance 126.

Figure 15:
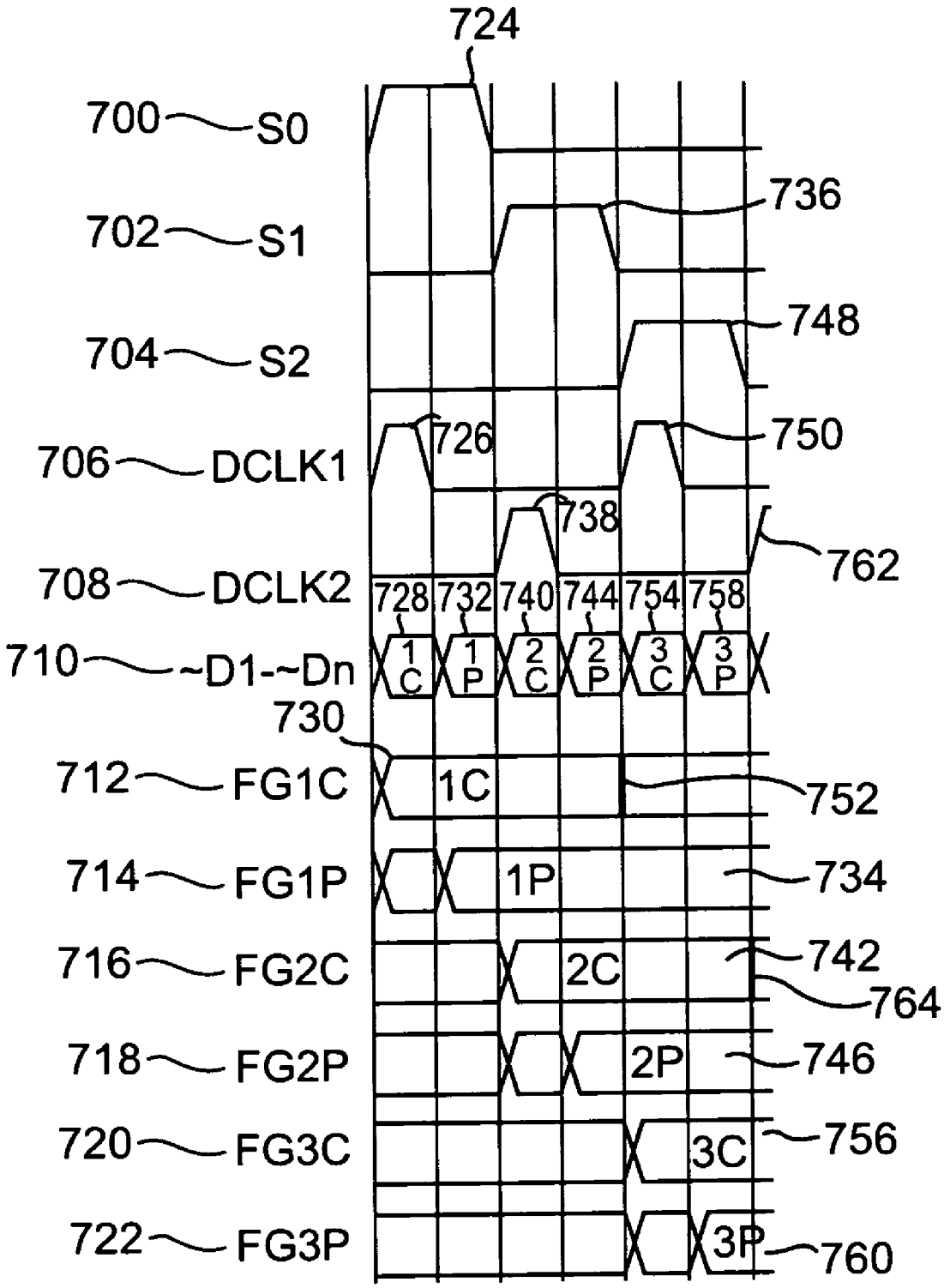
FIG. 15 is a timing diagram illustrating the operation of one embodiment of a double data rate firing cell firing cell circuit using the pre-charged firing cell of FIG. 12 and the two pass transistor pre-charged firing cell of FIG. 14.

FIG. 15 is a timing diagram illustrating the operation of one embodiment of a double data rate firing cell circuit using pre-charged firing cells 160 and two pass transistor pre-charged firing cells 180. The double data rate firing cell circuit includes a plurality of fire groups and each fire group includes substantially half pre-charged firing cells 160 and substantially half two pass transistor pre-charged firing cells 180.

The double data rate firing cell circuit includes a first fire group FG1, a second fire group FG2, a third fire group FG3 and other fire groups, up to fire group FGn. The double data rate firing cell circuit receives pre-charge/select signals S0, S1, S2 and other pre-charge/select signals, up to Sn. The first fire group FG1 receives signal S0 at 700 as a pre-charge signal and signal S1 at 702 as a select signal. The second fire group FG2 receives signal S1 at 702 as a pre-charge signal and signal S2 at 704 as a select signal. The third fire group FG3 receives signal S2 at 704 as a pre-charge signal and signal S3 (not shown) as a select signal and so on, up to fire group FGn that receives signal Sn-1 (not shown) as a pre-charge signal and signal Sn (not shown) as a select signal.

The double data rate firing cell circuit receives a first data clock signal DCLK1 at 706 via a first data clock and a second data clock signal DCLK2 at 708 via a second data clock. The first data clock is electrically coupled to all of the data clock lines 190 in pre-charged firing cells 180 in odd numbered fire groups, such as first fire group FG1 and third fire group FG3. The second data clock is electrically coupled to all of the data clock lines 190 in pre-charged firing cells 180 in even numbered fire groups, such as second fire group FG2 and fourth fire group FG4. The data select lines 170 of all pre-charged firing cells 160 in a fire group are electrically coupled to the pre-charge line of that fire group. Also, the pre-charge pass transistors 186 of all pre-charge firing cells 180 in a fire group are electrically coupled to the pre-charge line of that fire group.

The first data clock signal DCLK1 at 706 includes a high voltage pulse in the first half of each high voltage pulse in pre-charge signals of fire groups coupled to the first data clock and the second data clock signal DCLK2 at 708 includes a high voltage pulse in the first half of each high voltage pulse in pre-charge signals of fire groups coupled to the second data clock. Data lines provide data signals ~D1-~Dn at 710, wherein each of the data lines provides one of the data signals ~D1-~Dn at 710 and a first data bit during the first half of the high voltage pulse in a pre-charge signal and a second data bit during the second half of the high voltage pulse in the pre-charge signal. Each data line is electrically coupled to pre-charged firing cells 160 and two pass transistor pre-charged firing cells 180 in each of the fire groups FG1-FGn.

In odd numbered fire groups the first data clock signal DCLK1 at 706 and a pre-charge signal latch in two data bits during each high voltage pulse in the pre-charge signal. In even numbered fire groups the second data clock signal DCLK2 at 708 and a pre-charge signal latch in two data bits during each high voltage pulse in the pre-charge signal. In other embodiments of multiple data rate firing cell circuits that use pre-charge firing cells 160 and two pass transistor pre-charged firing cells 180, any suitable number of data clock signals can be used to latch in multiple data bits, such as three or more data bits, during the high voltage pulse of a pre-charge signal.

The fire groups FG1-FGn latch in the data signals ~D1-~Dn at 710 to provide latched in clocked data signals and latched in pre-charge data signals, which are used to turn on drive switches 172 to energize selected firing resistors 52. Each of the fire groups receives a fire signal that includes energy pulses to energize the selected firing resistors 52. In one embodiment, an energy pulse starts substantially toward the middle or end of the high voltage pulse in the select signal of the fire group to energize selected firing resistors 52 in the fire group.

The first fire group FG1 latches in data signals ~D1-~Dn at 710 to provide latched first fire group clocked data signals FG1C at 712 and latched first fire group pre-charge data signals FG1P at 714. The second fire group FG2 latches in data signals ~D1-~Dn at 710 to provide latched second fire group clocked data signals FG2C at 716 and latched second fire group pre-charge data signals FG2P at 718. The third fire group FG3 latches in data signals ~D1-~Dn at 710 to provide latched third fire group clocked data signals FG3C at 720 and latched third fire group pre-charge data signals FG3P at 722. The other fire groups also latch in data signals ~D1-~Dn at 710 to provide latched clocked data signals and latched pre-charge data signals similar to fire groups FG1-FG3.

Signal S0 at 700 provides a high voltage pulse at 724 in the pre-charge signal of the first fire group FG1. During the first half of the high voltage pulse at 724, first data clock signal DCLK1 at 706 provides a high voltage pulse at 726. Data signals ~D1-~Dn at 710 include the first fire group clocked data signals 1C at 728 that are passed through pre-charge pass transistors 186 coupled to the pre-charge line of the first fire group FG1 and clocked data latch transistors 184 coupled to the first data clock in the first fire group FG1 to provide the first fire group clocked data signals 1C at 730 in latched first fire group clocked data signals FG1C at 712. The first fire group clocked data signals 1C at 730 are latched in as the high voltage pulse 726 transitions to a low logic level. The first fire group clocked data signals 1C at 728 must be held until after the high voltage pulse 726 transitions below transistor threshold values.

During the second half of the high voltage pulse at 724, data signals ~D1-~Dn at 710 include first fire group pre-charge data signals 1P at 732. The first fire group pre-charge data signals 1P at 732 are passed through data latch transistors 162 that are coupled to the pre-charge line of the first fire group FG1 to provide the first fire group pre-charge data signals 1P at 734 in latched first fire group pre-charge data signals FG1P at 714. The first fire group pre-charge data signals 1P at 734 are latched into pre-charged firing cells 160 in the first fire group FG1 as the high voltage pulse 724 transitions to a low logic level. The first fire group pre-charge data signals 1P at 732 must be held until after the high voltage pulse 724 transitions below transistor threshold values.

Address signals are provided to select a row subgroup and signal S1 at 702 provides a high voltage pulse at 736 in the select signal of the first fire group FG1 and the pre-charge signal of the second fire group FG2. The high voltage pulse at 736 turns on select transistors 130 in the pre-charged firing cells 160 and select transistors 130 in the pre-charged firing cells 180 of first fire group FG1. In the addressed row subgroup, the storage node capacitances 126 either discharge if the latched first fire group data FG1C at 712 and FG1P at 714 is high or remain charged if the latched first fire group data FG1C at 712 and FG1P at 714 is low. In the row subgroups that are not addressed, the storage node capacitances 126 discharge regardless of the voltage level of latched first fire group data FG1C at 712 and FG1P at 714. An energy pulse is provided in the first fire group fire signal to energize firing resistors 52 coupled to conducting drive switches 172 in the addressed row subgroup.

During the first half of the high voltage pulse at 736, second data clock signal DCLK2 at 708 provides a high voltage pulse at 738. Data signals ~D1-~Dn at 710 include the second fire group clocked data signals 2C at 740 that are passed through pre-charge pass transistors 186 coupled to the pre-charge line of the second fire group FG2 and clocked data latch transistors 184 coupled to the second data clock in the second fire group FG2 to provide the second fire group clocked data signals 2C at 742 in latched second fire group clocked data signals FG2C at 716. The second fire group clocked data signals 2C at 742 are latched in as the high voltage pulse 738 transitions to a low logic level. The second fire group clocked data signals 2C at 740 must be held until after the high voltage pulse 738 transitions below transistor threshold values.

During the second half of the high voltage pulse at 736, data signals ~D1-~Dn at 710 include second fire group pre-charge data signals 2P at 744. The second fire group pre-charge data signals 2P at 744 are passed through data latch transistors 162 that are coupled to the pre-charge line of the second fire group FG2 to provide the second fire group pre-charge data signals 2P at 746 in latched second fire group pre-charge data signals FG2P at 718. The second fire group pre-charge data signals 2P at 746 are latched into pre-charged firing cells 160 in the second fire group FG2 as the high voltage pulse 736 transitions to a low logic level. The second fire group pre-charge data signals 2P at 744 must be held until after the high voltage pulse 736 transitions below transistor threshold values.

Address signals are provided to select a row subgroup and signal S2 at 704 provides a high voltage pulse at 748 in the select signal of the second fire group FG2 and the pre-charge signal of the third fire group FG3. The high voltage pulse at 748 turns on select transistors 130 in the pre-charged firing cells 160 and select transistors 130 in the pre-charged firing cells 180 of second fire group FG2. In the addressed row subgroup, the storage node capacitances 126 either discharge if the latched second fire group data FG2C at 716 and FG2P at 718 is high or remain charged if the latched second fire group data FG2C at 716 and FG2P at 718 is low. In the row subgroups that are not addressed, the storage node capacitances 126 discharge regardless of the voltage level of latched second fire group data FG2C at 716 and FG2P at 718. An energy pulse is provided in the first fire group fire signal to energize firing resistors 52 coupled to conducting drive switches 172 in the addressed row subgroup.

During the first half of the high voltage pulse at 748, first data clock signal DCLK1 at 706 provides a high voltage pulse at 750. This turns on clocked data latch transistors 184 in odd numbered fire groups, including the clocked data latch transistors 184 in the first fire group FG1. As the clocked data latch transistors 184 in the first fire group FG1 turn on, data in the latched first fire group clocked data signal FG1C at 712 becomes indeterminate at 752.

Data signals ~D1-~Dn at 710 include the third fire group clocked data signals 3C at 754 that are passed through pre-charge pass transistors 186 coupled to the pre-charge line of the third fire group FG3 and clocked data latch transistors 184 coupled to the first data clock in the third fire group FG3 to provide the third fire group clocked data signals 3C at 756 in latched third fire group clocked data signals FG3C at 720. The third fire group clocked data signals 3C at 756 are latched in as the high voltage pulse 750 transitions to a low logic level. The third fire group clocked data signals 3C at 754 must be held until after the high voltage pulse 750 transitions below transistor threshold values.

During the second half of the high voltage pulse at 748, data signals ~D1-~Dn at 710 include third fire group pre-charge data signals 3P at 758. The third fire group pre-charge data signals 3P at 758 are passed through data latch transistors 162 that are coupled to the pre-charge line of the third fire group FG3 to provide the third fire group pre-charge data signals 3P at 760 in latched third fire group pre-charge data signals FG3P at 722. The third fire group pre-charge data signals 3P at 760 are latched into pre-charged firing cells 160 in the third fire group FG3 as the high voltage pulse 748 transitions to a low logic level. The third fire group pre-charge data signals 3P at 758 must be held until after the high voltage pulse 748 transitions below transistor threshold values.

During the first half of a high voltage pulse in signal S3 (not shown), second data clock signal DCLK2 at 708 provides a high voltage pulse, indicated at 762. This turns on clocked data latch transistors 184 in even numbered fire groups, including the clocked data latch transistors 184 in the second fire group FG2. As the clocked data latch transistors 184 in the second fire group FG2 turn on, data in the latched second fire group clocked data signal FG2C at 716 becomes indeterminate at 764. The process continues up to and including fire group FGn that receives signal Sn-1 as a pre-charge signal and signal Sn as a select signal. The process then repeats itself beginning with the first fire group FG1 until ejecting fluid is completed.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device, comprising:

a first fire line configured to conduct a first energy signal including first energy pulses;

a second fire line configured to conduct a second energy signal including second energy pulses;

data lines configured to conduct data signals that represent an image;

latch circuitry configured to latch the data signals to provide latched data signals;

first drop generators configured to respond to the first energy signal to eject fluid based on the latched data signals; and second drop generators configured to respond to the second energy signal to eject fluid based on the latched data signals, wherein the latch circuitry latches the data signals via a clock signal and the latch circuitry latches the data signals via pulse charge control signals.

2. The fluid ejection device of claim 1, wherein one of the first energy pulses includes an initiation time and an end time and one of the second energy pulses is initiated between the initiation time and the end time.

3. The fluid ejection device of claim 1, wherein the first fire line is electrically isolated from the second fire line.

4. The fluid ejection device of claim 1, wherein the latched data signals include first latched data signals, second latched data signals, and third latched data signals and the latch circuitry comprises:

first latches configured to latch the data signals via a first clock signal to provide the first latched data signals;

second latches configured to latch the data signals via a second clock signal to provide the second latched data signals; and third latches configured to latch the data signals via the pulse charge control signals to provide the third latched data signals.

5. The fluid ejection device of claim 4, wherein a first portion of the first drop generators eject fluid based on the first latched data signals and a second portion of the first drop generators eject fluid based on the third latched data signals.

6. The fluid ejection device of claim 4, wherein a portion of the first drop generators eject fluid based on the first latched data signals and a portion of the second drop generators eject fluid based on the second latched data signals.

7. The fluid ejection device of claim 4, comprising first pass switches configured to pass the data signals to the first latches and the second latches based on the pulse charge control signals.

8. The fluid ejection device of claim 4, wherein the latched data signals include fourth latched data signals and comprising:

fourth latches configured to latch the data signals via a third clock signal to provide the fourth latched data signals.

9. A fluid ejection device, comprising:

a first fire line configured to conduct a first energy signal including first energy pulses;

a second fire line configured to conduct a second energy signal including second energy pulses;

data lines configured to conduct data signals that represent an image;

latch circuitry configured to latch the data signals to provide latched data signals based on at least one clock signal, the latch circuitry including first latches configured to latch the data signals via a first clock signal to provide first clocked data signals, the latch circuitry also including second latches configured to latch the data signals and the first clocked data signals via pulsed charge control signals to provide the latched data signals;

first drop generators configured to respond to the first energy signal to eject fluid based on the latched data signals; and second drop generators configured to respond to the second energy signal to eject fluid based on the latched data signals.

10. The fluid ejection device of claim 9, wherein a portion of the first drop generators eject fluid based on the first clocked data signals.

11. The fluid ejection device of claim 4, wherein the latch circuitry comprises:

third latches configured to latch the data signals via a second clock signal to provide second clocked data signals, wherein the second latches are configured to latch the data signals and the first clocked data signals and the second clocked data signals via the pulsed charge control signals to provide the latched data signals.

12. A fluid ejection device comprising:

means for conducting a first energy signal including first energy pulses;

means for conducting a second energy signal including second energy pulses;

means for conducting data signals that represent an image;

means for latching the data signals to provide latched data signals;

means for responding to the first energy signal to eject fluid based on the latched data signals; and means for responding to the second energy signal to eject fluid based on the latched data signals, wherein the means for latching includes;

means for latching the data signals via a clock signal: and means for latching the data signals via pulse charge control signals.

13. The fluid ejection device of claim 12, wherein the means for conducting a first energy signal is electrically isolated from the means for conducting a second energy signal.

14. The fluid ejection device of claim 12, wherein the latched data signals include first latched data signals, second latched data signals, and third latched data signals and the means for latching the data signals comprises:

means for latching the data signals via a first clock signal to provide the first latched data signals;

means for latching the data signals via a second clock signal to provide the second latched data signals; and means for latching the data signals via the pulse charge control signals to provide the third latched data signals.

15. The fluid ejection device of claim 14, comprising:

means for passing the data signals to the means for latching the data signals via a first clock signal and the means for latching the data signals via a second clock signal based on the pulse charge control signals.

16. A fluid ejection device comprising:

means for conducting a first energy signal including first energy pulses;

means for conducting a second energy signal including second energy pulses;

means for conducting data signals that represent an image;

means for latching the data signals to provide latched data signals based on at least one clock signal, the means for latching the data signals including means for latching the data signals via a first clock signal to provide first clocked data signals, the means for latching the data signals also including means for latching the data signals and the first clocked data signals via pulsed charge control signals to provide the latched data signals;

means for responding to the first energy signal to eject fluid based on the latched data signals; and means for responding to the second energy signal to eject fluid based on the latched data signals.

* * * * *

UNITED STATES PATENT AND TRADEMARK OFFICE

CERTIFICATE OF CORRECTION

PATENT NO. : 7,648,227 B2
APPLICATION NO. : 11/263733
DATED : January 19, 2010
INVENTOR(S) : Trudy Benjamin et al.

It is certified that error appears in the above-identified patent and that said Letters Patent is hereby corrected as shown below:

In column 36, line 17, in Claim 12, delete "includes;" and insert -- includes: --, therefor.

In column 36, line 18, in Claim 12, delete "signal:" and insert -- signal; --, therefor.

Signed and Sealed this

Fourth Day of May, 2010

David J. Kappos

David J. Kappos
*Director of the United States Patent and Trademark Office*